US006780558B2

(12) United States Patent
Yamada et al.

(10) Patent No.: US 6,780,558 B2
(45) Date of Patent: Aug. 24, 2004

(54) IMAGE FORMING METHOD

(75) Inventors: Hiroyuki Yamada, Tokyo (JP); Hiroshi Yamazaki, Tokyo (JP); Meizo Shirose, Tokyo (JP); Shigenori Kouno, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/126,356

(22) Filed: Apr. 19, 2002

(65) Prior Publication Data

US 2003/0198884 A1 Oct. 23, 2003

(51) Int. Cl.[7] ..... G03G 13/20; G03G 15/20

(52) U.S. Cl. ..... 430/124; 430/110.3; 430/110.4; 430/45; 399/294

(58) Field of Search ..... 430/45, 110.3, 430/110.4, 124; 399/299, 306, 320

(56) References Cited

U.S. PATENT DOCUMENTS

| | | | | |
|---|---|---|---|---|
| 5,329,342 A | * | 7/1994 | Shirai et al. | 355/285 |
| 5,830,617 A | | 11/1998 | Koyama et al. | 430/109 |
| 6,051,350 A | | 4/2000 | Inaba et al. | 430/45 |
| 6,248,494 B1 | | 6/2001 | Yamazaki et al. | 430/110 |
| 6,296,980 B1 | | 10/2001 | Oshiba et al. | 430/111 |
| 6,366,754 B1 | * | 4/2002 | Sato et al. | 399/223 |
| 6,440,630 B2 | | 8/2002 | Isobe et al. | 430/124 |
| 6,472,117 B1 | * | 10/2002 | Kohyama et al. | 430/110.3 |
| 6,497,984 B2 | | 12/2002 | Itami et al. | 430/125 |
| 2001/0004426 A1 | * | 6/2001 | Sato | 399/350 |
| 2003/0031481 A1 | | 2/2003 | Miho | 399/222 |

FOREIGN PATENT DOCUMENTS

| | | |
|---|---|---|
| JP | 2000-172004 | 6/2000 |
| JP | 2000-214629 | 8/2000 |
| JP | 2000-250259 | 9/2000 |
| JP | 2001-265145 | 9/2001 |
| JP | 2001-296694 | 10/2001 |

* cited by examiner

*Primary Examiner*—John L Goodrow
(74) *Attorney, Agent, or Firm*—Squire, Sanders & Dempsey, L.L.P.

(57) ABSTRACT

An electrophotographic image forming method is disclosed. The method comprises developing latent images each formed on a static latent image forming member by serially arranged plural image forming units each including a toner to form toner images, respectively, successively transferring the toner images onto an image support so as to form a piled up image, and fixing the piled up image by a fixing device having a rotatable heating member including a heater fixed therein and a pressing member, and in the method the toner for developing the latent image has a variation coefficient of the shape coefficient of not more than 16% and a number variation coefficient of the particle diameter distribution in number of not more than 27%.

30 Claims, 12 Drawing Sheets

TONER HAVING NO CORNERS

TONER HAVING CORNERS

TONER HAVING CORNERS

IMAGE FORMING METHOD

FIELD OF THE INVENTION

This invention relates to an image forming method, an image forming apparatus and a developing toner to be used therein.

BACKGROUND OF THE INVENTION

Recently, electrophotography is utilized in various fields, for example, not only in the field of monochromatic copying machine but in the fields of printer as the output terminal of computer, color copy machine and color printer.

Requirement to the image quality is made higher accompanied with the progress of the utilization. As the color image formation method, a method in which plural images are piled on a photoreceptor and then the images are transferred all at once onto an image support and a method in which the plural images are piled on an intermediate transfer member and transferred onto the image forming support have been know. These methods, however, has a shortcoming that the image forming speed of full color image is become to ¼ or less of that of the monochromatic image formation since the color images are successively formed and fixed after finishing of the full color image formation.

A method so called tandem system is proposed to solve the problem. In such the method, set of a static latent image forming member or a photoreceptor and a developing device, namely an image forming unit, for each of the colors are arranged in the image forming apparatus.

This method is noticed as an image forming method with a very high efficiency since there is no difference in the printing speed of a monochromatic image and that of a full color image even though the mechanism of the apparatus is become complex because the photoreceptor and the developing device are necessary for each color. In this image forming method, the images formed in each color developing devices are once transferred onto an intermediate transfer member and then transferred onto an image support (transfer material) or the each color toner images are successively and directly transferred onto the image forming support and fixed.

In such the system, however, the image formed on (intermediate) image support member repeatedly receives an effect of static treatment such as corona discharge. Therefore, the degree of the influence of such the effect on the firstly formed image is different from that on the lastly formed image. Such the difference of the influence degree is the same when the toner images are directly transferred to the image support.

The images are further subjected to such the static influence largely in the course of the transferring process and the fixing process. Consequently, repulsion and off-set caused by the static force are occurred, and problems of blur character due to toner scattering and discrepancy of color images tend to be raised.

Therefore, the tandem system is insufficient as the color forming method to form a high quality image.

SUMMARY OF THE INVENTION

The object of the invention is to provide an image forming method, an image forming apparatus and a developing toner to be used in them by which a high quality image without occurrence of the blur character due to toner scattering and image discrepancy (drift of colors) by the tandem color image forming system.

The invention and its embodiments are described below.

An image forming method comprising the steps of developing latent images each formed on a static latent image forming member by serially arranged plural image forming units each including a toner to form toner images, respectively, successively transferring the toner images onto an image support so as to form a piled up image, and fixing the piled up image by a fixing device having a rotatable heating member including a heater fixed therein and a pressing member, wherein the toner for developing the latent image has a variation coefficient of the shape coefficient of not more than 16% and a number variation coefficient of the particle diameter distribution in number of not more than 27%.

It is preferable in the image forming method that the developing toner contains toner particles each having a shape coefficient within the range of from 1.0 to 1.6 in a ratio of not less than 65% in number.

The developing toner preferably contains toner particles each having a shape coefficient within the range of from 1.2 to 1.6 in a ratio of not less than 65% in number.

The developing toner preferably contains toner particles having no corner in a ratio of not less than 50% in number.

The developing toner preferably has a number average diameter of from 3 to 8 $\mu$m.

It is preferable that the sum M of a relative frequency of the toner particles included in the highest frequency class m1 and a relative frequency of the toner particles included the next high frequency class m2 is not less than 70% in a histogram showing a particle diameter distribution in number classified into plural classes every 0.23 of natural logarithm ln D graduated on the horizontal axis of the histogram, where D is the diameter of the toner particle in $\mu$m.

The developing toner is preferably one prepared by polymerizing a polymerizable monomer in an aqueous medium.

The developing toner is preferably one prepared by association of resin particles in an aqueous medium.

An image forming method comprising the steps of developing latent images each formed on a static latent image forming member by serially arranged plural image forming units each including a toner to form toner images, respectively, successively transferring the toner images onto an image support member so as to form a piled up image, and fixing the piled up image by a fixing device having a rotatable heating member including a heater fixed therein and a pressing member, wherein the toner for developing the latent image contains toner particles having no corner in a ratio of not less than 50% and a number variation coefficient of the particle diameter distribution in number of not more than 27%.

An image forming method comprising the steps of developing latent images each formed on a static latent image forming member by serially arranged plural image forming units each including a toner to form toner images, respectively, successively transferring the toner images onto an image support member so as to form a piled up image, and fixing the piled up image by a fixing device having a rotatable heating member including a heater fixed therein and a pressing member, wherein the toner for developing the latent image contains toner particles each having a shape coefficient within the range of from 1.2 to 1.6 in a ratio of not less than 65% in number and a variation coefficient of the shape coefficient of not more than 16%.

An image forming apparatus for developing latent images each formed on a static latent image forming member by serially arranged plural image forming units each including a toner to form toner images, respectively, successively transferring the toner images onto an image support member so as to form a piled up image, and fixing the piled up image by a fixing device having a rotatable heating member including a heater fixed therein and a pressing member, wherein the toner for developing the latent image each has a variation coefficient of the shape coefficient of not more than 16% and a number variation coefficient of the particle diameter distribution in number of not more than 27%.

An image forming apparatus for developing latent images each formed on a static latent image forming member by serially arranged plural image forming units each including a toner to form toner images, respectively, successively transferring the toner images onto an image support member so as to form a piled up image, and fixing the piled up image by a fixing device having a rotatable heating member including a heater fixed therein and a pressing member, wherein the toner for developing the latent image contains toner particles having no corner in a ratio of not less than 50% and a number variation coefficient of the particle diameter distribution in number of not more than 27%.

An image forming apparatus for developing latent images each formed on a static latent image forming member by serially arranged plural image forming units each including a toner to form toner images, respectively, successively transferring the toner images onto an image support member so as to form a piled up image, and fixing the piled up image by a fixing device having a rotatable heating member including a heater fixed therein and a pressing member, wherein the toner for developing the latent image contains toner particles each having a shape coefficient within the range of from 1.2 to 1.6 in a ratio of not less than 65% in number and a variation coefficient of the shape coefficient of not more than 16%.

A toner for developing toner to be used in an image forming method comprising the steps of developing latent images each formed on a static latent image forming member by serially arranged plural image forming units each including a toner to form toner images, respectively, successively transferring the toner images onto an image support member so as to form a piled up image, and fixing the piled up image by a fixing device having a rotatable heating member including a fixed heater and a pressing member, wherein the toner for developing the latent image each has a variation coefficient of the shape coefficient of not more than 16% and a number variation coefficient of the particle diameter distribution in number of not more than 27%.

A toner for developing toner to be used in an image forming method comprising the steps of developing latent images each formed on a static latent image forming member by serially arranged plural image forming units each including a toner to form toner images, respectively, successively transferring the toner images onto an image support member so as to form a piled up image, and fixing the piled up image by a fixing device having a rotatable heating member including a heater fixed therein and a pressing member, wherein the toner for developing the latent image contains toner particles having no corner in a ratio of not less than 50% and a number variation coefficient of the particle diameter distribution in number of not more than 27%.

A toner for developing toner to be used in an image forming method comprising the steps of developing latent images each formed on a static latent image forming member by serially arranged plural image forming units each including a toner to form toner images, respectively, successively transferring the toner images onto an image support member so as to form a piled up image, and fixing the piled up image by a fixing device having a rotatable heating member including a heater fixed therein and a pressing member, wherein the toner for developing the latent image contains toner particles each having a shape coefficient within the range of from 1.2 to 1.6 in a ratio of not less than 65% in number and a variation coefficient of the shape coefficient of not more than 16%.

BRIEF DESCRIPTION OF THE DRAWING

FIGS. 10(*b*) and 10(*c*) are explanatory views showing projection images of toner particles having corners.

DETAILED DESCRIPTION OF THE INVENTION

Figure 1:
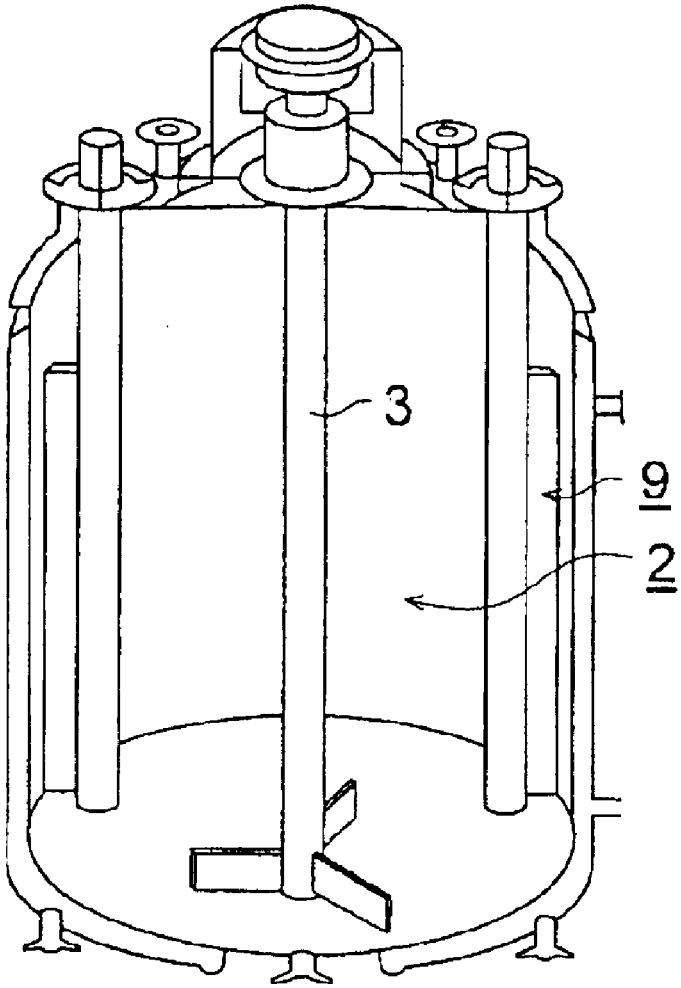
FIG. 1 is a view explaining a reaction apparatus having one level configuration of the stirring blade.

It has been found by the inventors that the foregoing problems can be solved by the use of the toner having a variation coefficient of the shape coefficient of not more than 16% and a number variation coefficient of the particle diameter distribution of not more than 27%. Namely, the occurrence of the image defects can be prevented by making uniform the shape of the toner particles so as to make narrow the charge amount distribution of the toner particle at the time of the transfer.

It has been further found that the same effects can be obtained by the toner particles having no corner even when the scatter of the shape is large a little since the charge is not excessively accumulated by the smoothness of the particle surface. Namely, the problems to be solved by the invention can be solved by the use of the toner having a content of particles having no corner of not less than 50% and a number variation coefficient of the particle diameter distribution in number of not more than 27%.

It has been further found that the charging ability of the toner particles can be made uniform by unifying the shape of the toner particle to a specified shape. Namely, the problems to be solved by the invention can be solved by the use of toner containing the toner particles having a shape coefficient within the range of from 1.2 to 1.6 in a ratio of not less than 65% in number and a variation coefficient of the shape coefficient of not more than 16%.

It has been found as a result of investigation on the charging amount distribution of the toner that the scatter of the shape of the particle has to be controlled to small together with controlling the scatter of the toner particle diameter so as to be small. The stable charging ability during a prolonged period can be obtained by making the distribution of the charging amount of the toner particles to be extremely narrow even when the charging amount of the toner is set at a low value.

The invention is attained by the found, as a result of the investigation from the foregoing viewpoint, that a high quality image without the blur character due to toner scattering and the color discrepancy can be formed during a prolonged period by the use of the toner having a variation coefficient of the shape coefficient of not more than 16% and a variation coefficient of number of the particle diameter distribution in number.

As a result of the investigation on the microscopic shape of the toner particle, it has been found that the corner portion of the toner particle is rounded and such the portion causes the stain. It is presumed that stress is easily applied at the corner of the particle to vary the charging ability of the toner particle even though the reason of such the phenomenon is not cleared. When the charge is given by triboelectricity, it is supposed that the charge is tend to be concentrated particularly at the corner portion so as to make uneven the charge of the toner particles.

The invention is attained by the found that a high quality image without the blur character due to toner scattering and the color discrepancy can also be formed during a prolonged period by making the content of the particles without corner to not less than 50% in number and controlling the number variation coefficient of the particle diameter distribution in number of not more than 27%.

Moreover, it has been found that the charging amount distribution can be made sharp when the shape of the toner particles is unified to the specified shape. Namely, a high quality image without the blur character due to toner scattering and the color discrepancy can be formed during a prolonged period by the use of the toner containing having a shape coefficient within the range of from 1.2 to 1.6 in a ratio of not less than 65° and a variation coefficient of the shape coefficient of not more than 16%. Thus the invention can be attained.

The shape coefficient of the toner particles of the present invention is expressed by the formula described below and represents the roundness of toner particles.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane.

In the present invention, said shape coefficient was determined in such a manner that toner particles were photographed under a magnification factor of 2,000, employing a scanning type electron microscope, and the resultant photographs were analyzed employing "Scanning Image Analyzer", manufactured by JEOL Ltd. At that time, 100 toner particles were employed and the shape coefficient of the present invention was obtained employing the aforementioned calculation formula.

In one of the embodiment of the invention the toner preferably has a number ratio of toner particles having a shape coefficient of 1.0 to 1.6 and is at least 65 percents and more preferably 70 percent or more, and further number ratio of toner particles having a shape coefficient of 1.2 to 1.6 and is at least 65 percent, and particularly preferably 70 percent or more.

According to such characteristics as shape coefficient and number ratio of toner particles high toner filling density in a toner layer which is transferred to an intermediate transfer material is obtained, fluctuation of transfer characteristics of toner between different colors at the second image transfer process to an image forming support is reduced, and therefore, a good transfer characteristics is obtained. Further variation of adhesion property in each color is lowered and therefore a color image can be obtained stably since the toner particle is not easily crashed, stain on the charging member is reduced and charging characteristics of the toner becomes stable.

The polymerized toner of the present invention is that the number ratio of toner particles in the range of said shape coefficient of 1.2 to 1.6 is preferably at least 65 percent and is more preferably at least 70 percent.

Methods to control said shape coefficient are not particularly limited. For example, a method may be employed wherein a toner, in which the shape coefficient has been adjusted to the range of 1.2 to 1.6, is prepared employing a method in which toner particles are sprayed into a heated air current, a method in which toner particles are subjected to application of repeated mechanical forces employing impact in a gas phase, or a method in which a toner is added to a solvent which does not dissolve said toner and is then subjected to application of a revolving current, and the resultant toner is blended with a toner to obtain suitable characteristics. Further, another preparation method may be employed in which, during the stage of preparing a so-called polymerization method toner, the entire shape is controlled and the toner, in which the shape coefficient has been adjusted to 1.0 to 1.6 or 1.2 to 1.6, is blended with a common toner.

The toner obtained by polymerization method is preferable in view of simple preparation and excellent in uniform surface property comparing with the pulverized toner.

The variation coefficient of the shape coefficient of the polymerized toner is calculated using the formula described below:

$$\text{Variation coefficient}=(S/K)\times 100(\text{in percent})$$

wherein S represents the standard deviation of the shape coefficient of 100 toner particles and K represents the average of said shape coefficient.

The variation coefficient is preferably not more than 16%, and more preferably not more than 14% in the present invention. Gaps between toner particles in the toner layer are reduced, the transfer characteristics is minimized at the second transfer to the image forming support and therefore good image transfer characteristics is obtained. Further image characteristics is improved because sharp charging distribution is obtained.

In order to uniformly control said shape coefficient of toner as well as the variation coefficient of the shape coefficient with minimal fluctuation of production lots, the optimal finishing time of processes may be determined while monitoring the properties of forming toner particles (colored particles) during processes of polymerization, fusion, and shape control of resinous particles (polymer particles).

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

The number particle distribution as well as the number variation coefficient of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer. Employed as used in said Multisizer was one of a 100 $\mu$m aperture. The volume and the number of particles having a diameter of at least 2 $\mu$m were measured and the size distribution as well as the average particle diameter was calculated. The number particle distribution, as described herein, represents the relative frequency of toner particles with respect to the particle diameter, and the number average particle diameter as described herein expresses the median diameter in the number particle size distribution. The number variation coefficient in the number particle distribution of toner is calculated employing the formula described below:

$$\text{Number variation coefficient}=(S2/D_n)\times 100(\text{in percent})$$

wherein S2 represents the standard deviation in the number particle size distribution and $D_n$ represents the number average particle diameter (in $\mu$m).

The number variation coefficient of the toner of the present invention is not more than, preferably, 27 percent, and is more preferably not more than 25 percent. By adjusting the number variation coefficient to not more than 27 percent, voids of the transferred toner layer decrease to improve transfer efficiency at the second transfer to the image forming support and therefore good image transfer characteristics is obtained. Further, the width of the charge amount distribution is narrowed and image quality is enhanced due to an increase in transfer efficiency.

Methods to control the number variation coefficient of the present invention are not particularly limited. For example, employed may be a method in which toner particles are classified employing forced air. However, in order to further decrease the number variation coefficient, classification in liquid is also effective. In said method, by which classification is carried out in a liquid, is one employing a centrifuge so that toner particles are classified in accordance with differences in sedimentation velocity due to differences in the diameter of toner particles, while controlling the frequency of rotation.

Specifically, when a toner is produced employing a suspension polymerization method, in order to adjust the number variation coefficient in the number particle size distribution to not more than 27 percent, a classifying operation may be employed. In the suspension polymerization method, it is preferred that prior to polymerization, polymerizable monomers be dispersed into a water based medium to form oil droplets having the desired size of the toner. Namely, large oil droplets of said polymerizable monomers are subjected to repeated mechanical shearing employing a homomixer, a homogenizer, and the like to decrease the size of oil droplets to approximately the same size of the toner. However, when employing such a mechanical shearing method, the resultant number particle size distribution is broadened. Accordingly, the particle size distribution of the toner, which is obtained by polymerizing the resultant oil droplets, is also broadened. Therefore classifying operation may be employed.

Figure 10:
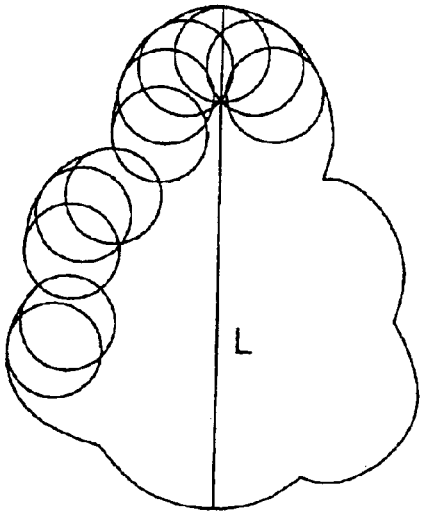
FIG. 10(*a*) is an explanatory view showing a projection image of toner particle having no corners.
Figure 10:
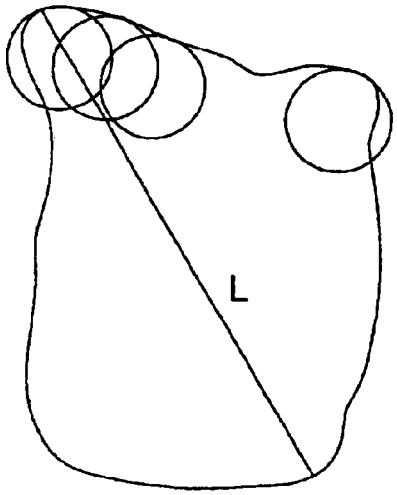
Figure 10:
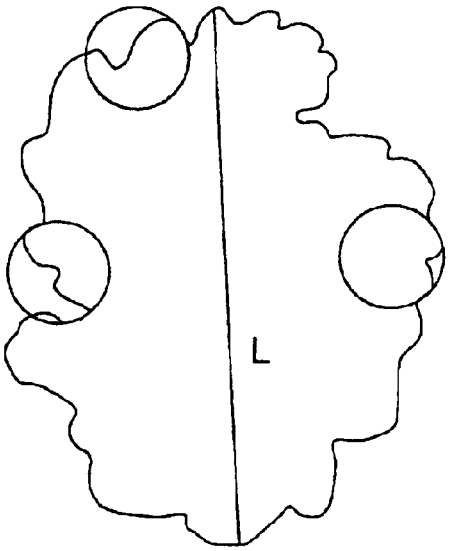

The toner particles of the present invention, which substantially have no corners, as described herein, mean those having no projection to which charges are concentrated or which tend to be worn down by stress. Namely, as shown in FIG. 10(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference. Further, "the main axis of a toner particle" as described herein means the maximum width of said toner particle when the projection image of said toner particle onto a flat plane is placed between two parallel lines. Incidentally, FIGS. 10(*b*) and 10(*c*) show the projection images of a toner particle having corners.

Toner having no corners was measured as follows. First, an image of a magnified toner particle was made employing a scanning type electron microscope. The resultant picture of the toner particle was further magnified to obtain a photographic image at a magnification factor of 15,000.

Subsequently, employing the resultant photographic image, the presence and absence of said corners was determined. Said measurement was carried out for 100 toner particles.

The number ratio of toner particles having no corners is set preferably at least 50 percent, and or more preferably at least 70 percent. By adjusting the number ratio of toner particles having no corner as above, voids of the transferred toner layer decrease to improve transfer efficiency at the second transfer to the image forming support and therefore good image transfer characteristics is obtained. Further, the width of the charge amount distribution is narrowed and image quality is enhanced due to an increase in transfer efficiency since number of toners which are prone to be wore or crashed and have charge concentration portions reduces.

Methods to obtain toner having no corners are not particularly limited. For example, as previously described as the method to control the shape coefficient, it is possible to obtain toner having no corners by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current.

Further, in a polymerized toner which is formed by associating or fusing resinous particles, during the fusion terminating stage, the fused particle surface is markedly uneven and has not been smoothed. However, by optimizing conditions such as temperature, rotation frequency of impeller, the stirring time, and the like, during the shape controlling process, toner particles having no corners can be obtained. These conditions vary depending on the physical properties of the resinous particles. For example, by setting the temperature higher than the glass transition point of said resinous particles, as well as employing a higher rotation frequency, the surface is smoothed. Thus it is possible to form toner particles having no corners.

The diameter of the toner particles of the present invention is preferably between 3 and 8 $\mu$m in terms of the number average particle diameter. When toner particles are formed employing a polymerization method, it is possible to control said particle diameter utilizing the concentration of coagulants, the added amount of organic solvents, the fusion time, or further the composition of the polymer itself.

By adjusting the number average particle diameter from 3 to 8 $\mu$m, it is possible to decrease the presence of toner and the like which is adhered excessively to the developer conveying member or exhibits low adhesion, and thus stabilize developability over an extended period of time. At the same time, improved is the halftone image quality as well as general image quality of fine lines, dots, and the like.

The polymerized toner, which is preferably employed in the present invention, is as follows. The diameter of toner particles is designated as D (in $\mu$m). In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class. By adjusting the sum (M) of the relative frequency ($m_1$) and the relative frequency ($m_2$) to at least 70 percent, the dispersion of the resultant toner particle size distribution narrows. Thus, by employing said toner in an image forming process, it is possible to securely minimize the generation of selective development.

In the present invention, the histogram, which shows said number based particle size distribution, is one in which natural logarithm lnD (wherein D represents the diameter of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). Said histogram is drawn by a particle size distribution analyzing program in a computer through transferring to said computer via the I/O unit particle diameter data of a sample which are measured employing a Coulter Multisizer under the conditions described below.

(Measurement Conditions)

(1) Aperture: 100 $\mu$m (2) Method for preparing samples: an appropriate amount of a surface active agent (a neutral detergent) is added while stirring in 50 to 100 ml of an electrolyte, Isoton R-11 (manufactured by Coulter Scientific Japan Co.) and 10 to 20 ml of a sample to be measured is added to the resultant mixture. Preparation is then carried out by dispersing the resultant mixture for one minute employing an ultrasonic homogenizer.

Numeral characteristics of the toner, which depends on the preparation method, is described.

In the case of the usually known toner produced by a pulverizing method, the ratio of the particles having a shape coefficient within the range of from 1.2 to 1.6 is approximately 60% in number. The variation coefficient of the shape coefficient of such the toner is about 20%. In the toner by the crushing method, the ratio of the toner particles having no corner is not more than 30% in number since the particle size is made small by repeating the crushing accordingly the corner is formed on many toner particles. Therefore, a treatment for making sphere the shape of the toner particle by heating is necessary for controlling the shape coefficient to obtain atoner particles each uniformly has a rounded shape without corner. The number variation coefficient of the particle diameter distribution in number is about 30% when the classifying after crushing is performed only once. The classifying operation has to be repeated to obtain the number variation coefficient of not more than 27%.

Toner particles each having a true sphere shape can be obtained since the polymerization is performed in a layer flowing. For example, the ratio of the particles having a shape coefficient within the range of from 1.2 to 1.6 is approximately 20% in number, the variation coefficient of the shape coefficient is about 18%, and the ratio of the particle having no corner is about 85% in number in the toner described in Japanese Patent Publication Open to Public Inspection, hereinafter referred to as JP O.P.I., No. 63-186253. In the production process of the toner, large oil drop of the polymerizable monomer is make small to the size of the toner particle by repeating the mechanical tearing. Therefore, the distribution of the oil drop size is spread and the variation coefficient of number is as large as about 32%, and the classifying process is necessary to lower the variation coefficient of number.

In the polymerization toner produced by association or melt-adhesion of the resin particles, for example, the toner described in JP O.P.I. No. 63-186253, the ratio of the particles having a shape coefficient within the range of from 1.2 to 1.6 is approximately 60% in number, the variation coefficient of the shape coefficient is about 18%, and the ratio of the particle having no corner is about 44% in number. The distribution of diameter is wide and the variation coefficient of number is 30%. A classifying process is necessary to lower the variation coefficient of number.

Preferable embodiment of the invention is described. It is possible to prepare the toner of the present invention in such a manner that fine polymerized particles are produced employing a suspension polymerizing method, and emulsion polymerization of monomers in a liquid added with an emulsion of necessary additives is carried out, and thereafter, association is carried out by adding organic solvents, coagulants, and the like. Methods are listed in which during association, preparation is carried out by associating upon mixing dispersions of releasing agents, colorants, and the like which are required for constituting a toner, a method in which emulsion polymerization is carried out upon dispersing toner constituting components such as releasing agents, colorants, and the like in monomers, and the like. Association as described herein means that a plurality of resinous particles and colorant particles are fused.

The aqueous medium comprises at least 50% by weight of water.

An example of preparation method of the toner particles is described. Namely, added to the polymerizable monomers are colorants, and if desired, releasing agent, charge control agents, and further, various types of components such as polymerization initiators, and in addition, various components are dissolved in or dispersed into the polymerizable monomers employing a homogenizer, a sand mill, a sand grinder, an ultrasonic homogenizer, and the like. The polymerizable monomers in which various components have been dissolved or dispersed are dispersed into a water based medium to obtain oil droplets having the desired size of a toner, employing a homomixer, a homogenizer, and the like. Thereafter, the resultant dispersion is conveyed to a reaction apparatus which utilizes stirring blades described below as the stirring mechanism and undergoes polymerization reaction upon heating . . . After completing the reaction, the dispersion stabilizers are removed, filtered, washed, and subsequently dried. In this manner, the toner of the present invention is prepared.

A method for preparing said toner may includes one in which resinous particles are associated, or fused, in a water based medium. Said method is not particularly limited but it is possible to list, for example, methods described in Japanese Patent Publication Open to Public Inspection Nos. 5-265252, 6-329947, and 9-15904.

It is possible to form the toner of the present invention by employing a method in which at least two of the dispersion particles of components such as resinous particles, colorants, and the like, or fine particles, comprised of resins, colorants, and the like, are associated, specifically in such a manner that after dispersing these in water employing emulsifying agents, the resultant dispersion is salted out by adding coagulants having a concentration of at least the critical coagulating concentration, and simultaneously the formed polymer itself is heat-fused at a temperature higher than the glass transition temperature, and then while forming said fused particles, the particle diameter is allowed gradually to grow; when the particle diameter reaches the desired value, particle growth is stopped by adding a relatively large amount of water; the resultant particle surface is smoothed while being further heated and stirred, to control the shape and the resultant particles which incorporate water, is again heated and dried in a fluid state. Further, herein, organic solvents, which are infinitely soluble in water, may be simultaneously added together with said coagulants.

Those which are employed as polymerizable monomers to constitute resins include styrene and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butylacrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; as well as derivatives of acrylic acid or methacrylic acid such as acrylonitrile, methacrylonitrile, acryl amide, and the like. These vinyl based monomers may be employed individually or in combinations.

Further preferably employed as polymerizable monomers, which constitute said resins, are those having an ionic dissociating group in combination, and include, for instance, those having substituents such as a carboxyl group, a sulfonic acid group, a phosphoric acid group, and the like as the constituting group of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, 3-chlor-2-acid phosphoxypropyl methacrylate, and the like.

Further, it is possible to prepare resins having a bridge structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

It is possible to polymerize these polymerizable monomers employing radical polymerization initiators. In such a case, it is possible to employ oil-soluble polymerization initiators when a suspension polymerization method is carried out. Listed as these oil-soluble polymerization initiators may be azo based or diazo based polymerization initiators such as 2,2'-azobis-(2,4-dimethylvaleronitrile), 2,2'-azobisisobutyronitrile, 1,1'-azobiscyclohexanone-1-carbonitrile), 2,2'-azobis-4-methoxy-2,4-dimethylvaleronitrile, azobisisobutyronitrile, and the like; peroxide based polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexane)propane, tris-(t-butylperoxy) triazine, and the like; polymer initiators having a peroxide in the side chain; and the like.

Further, when such an emulsion polymerization method is employed, it is possible to use water-soluble radical polymerization initiators. Listed as such water-soluble polymerization initiators may be persulfate salts, such as potassium persulfate, ammonium persulfate, and the like, azobisaminodipropane acetate salts, azobiscyanovaleric acid and salts thereof, hydrogen peroxide, and the like.

Cited as dispersion stabilizers may be tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina, and the like. Further, as dispersion stabilizers, it is possible to use polyvinyl alcohol, gelatin, methyl cellulose, sodium dodecylbenzene sulfonate, ethylene oxide addition products, and compounds which are commonly employed as surface active agents such as sodium higher alcohol sulfate.

In the present invention, preferred as excellent resins are those having a glass transition point of 20 to 90° C. as well as a softening point of 80 to 220° C. Said glass transition point is measured employing a differential thermal analysis method, while said softening point can be measured employing an elevated type flow tester. Preferred as these resins are those having a number average molecular weight (Mn) of 1,000 to 100,000, and a weight average molecular weight (Mw) of 2,000 to 100,000, which can be measured employing gel permeation chromatography. Further preferred as resins are those having a molecular weight distribution of Mw/Mn of 1.5 to 100, and is most preferably between 1.8 and 70.

The coagulants employed in the present invention are preferably selected from metallic salts. Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc. Some specific examples of these salts are described below. Listed as specific examples of monovalent metal salts, are sodium chloride, potassium chloride, lithium chloride; while listed as divalent metal salts are calcium chloride, zinc chloride, copper sulfate, magnesium sulfate, manganese sulfate, etc., and listed as trivalent metal salts, are aluminum chloride, ferric chloride, etc. Any of these are suitably selected in accordance with the application.

The coagulant is preferably added not less than the critical coagulation concentration. The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to a particle dispersion while changing the salt concentration to measure the ζ potential of the dispersion, and in addition the critical coagulation concentration may be obtained as the salt concentration which initiates a variation in the ζ potential.

The concentration of coagulant may be not less than the critical coagulation concentration. However, the amount of the added coagulant is preferably at least 1.2 times of the critical coagulation concentration, and more preferably 1.5 times.

The solvents, which are infinitely soluble as described herein, mean those which are infinitely soluble in water, and in the present invention, such solvents are selected which do not dissolve the formed resins. Specifically, listed may be alcohols such as methanol, ethanol, propanol, isopropanol, t-butanol, methoxyethanol, butoxyethanol, and the like. Ethanol, propanol, and isopropanol are particularly preferred.

The added amount of infinitely soluble solvents is preferably between 1 and 100 percent by volume with respect to the polymer containing dispersion to which coagulants are added.

In order to make the shape of particles uniform, it is preferable that colored particles are prepared, and after filtration, the resultant slurry, containing water in an amount of 10 percent by weight with respect to said particles, is subjected to fluid drying. At that time, those having a polar group in the polymer are particularly preferable. For this reason, it is assumed that since existing water somewhat exhibits swelling effects, the uniform shape particularly tends to be made.

The toner of the present invention is comprised of at least resins and colorants. However, if desired, said toner may be comprised of releasing agents, which are fixability improving agents, charge control agents, and the like. Further, said toner may be one to which external additives, comprised of fine inorganic particles, fine organic particles, and the like, are added.

Examples of colorants include carbon black, magnetic materials, dyes, pigments, and the like. Employed as carbon blacks are channel black, furnace black, acetylene black, thermal black, lamp black, and the like. Employed as ferromagnetic materials may be ferromagnetic metals such as iron, nickel, cobalt, and the like, alloys comprising these metals, compounds of ferromagnetic metals such as ferrite, magnetite, and the like, alloys which comprise no ferromagnetic metals but exhibit ferromagnetism upon being thermally treated such as, for example, Heusler's alloy such as manganese-copper-aluminum, manganese-copper-tin, and the like, and chromium dioxide, and the like.

Employed as dyes may be C.I. Solvent Red 1, the same 49, the same 52, the same 63, the same 111, the same 122, C.I. Solvent Yellow 19, the same 44, the same 77, the same 79, the same 81, the same 82, the same 93, the same 98, the same 103, the same 104, the same 112, the same 162, C.I. Solvent Blue 25, the same 36, the same 60, the same 70, the same 93, the same 95, and the like, and further mixtures thereof may also be employed. Employed as pigments may be C.I. Pigment Red 5, the same 48:1, the same 53:1, the same 57:1, the same 122, the same 139, the same 144, the same 149, the same 166, the same 177, the same 178, the same 222, C.I. Pigment Orange 31, the same 43, C.I. Pigment Yellow 14, the same 17, the same 93, the same 94, the same 138, C.I. Pigment Green 7, C.I. Pigment Blue 15:3, the same 60, and the like, and mixtures thereof may be employed. The number average primary particle diameter varies widely depending on their types, but is preferably between about 10 and about 200 nm.

Employed as methods for adding colorants may be those in which polymers are colored during the stage in which polymer particles prepared employing the emulsification method are coagulated by addition of coagulants, in which colored particles are prepared in such a manner that during the stage of polymerizing monomers, colorants are added and the resultant mixture undergoes polymerization, and the like. Further, when colorants are added during the polymer preparing stage, it is preferable that colorants of which surface has been subjected to treatment employing coupling agents, and the like, so that radical polymerization is not hindered.

Further, added as fixability improving agents may be low molecular weight polypropylene (having a number average molecular weight of 1,500 to 9,000), low molecular weight polyethylene, and the like. Example of the ester type wax includes carnauba wax, candela wax and microcrystalline wax.

Employed as charge control agents may also be various types of those which are known in the art and can be dispersed in water. Specifically listed are nigrosine based dyes, metal salts of naphthenic acid or higher fatty acids, alkoxylated amines, quaternary ammonium salts, azo based metal complexes, salicylic acid metal salts or metal complexes thereof. It is preferable that the number average primary particle diameter of particles of said charge control agents as well as said fixability improving agents is adjusted to about 10 to about 500 nm in the dispersed state.

In toners prepared employing a suspension polymerization method in such a manner that toner components such as colorants, and the like, are dispersed into, or dissolved in, so-called polymerizable monomers, the resultant mixture is suspended into a water based medium; and when the resultant suspension undergoes polymerization, it is possible to control the shape of toner particles by controlling the flow of said medium in the reaction vessel. Namely, when toner particles, which have a shape coefficient of at least 1.2, are formed at a higher ratio, employed as the flow of the medium in the reaction vessel, is a turbulent flow. Subsequently, oil droplets in the water based medium in a suspension state gradually undergo polymerization. When the polymerized oil droplets become soft particles, the coagulation of particles is promoted through collision and particles having an undefined shape are obtained. On the other hand, when toner particles, which have a shape coefficient of not more than 1.2, are formed, employed as the flow of the medium in the reaction vessel is a laminar flow. Spherical particles are obtained by minimizing collisions among said particles. By employing said methods, it is possible to control the distribution of shaped toner particles within the range of the present invention.

In the suspension polymerization method, it is possible to form a turbulent flow employing specified stirring blades and to readily control the resultant shape of particles. The reason for this phenomenon is not clearly understood. When the stirring blades 4 are positioned at one level, as shown in FIG. 1, the medium in stirring tank 2 flows only from the bottom part to the upper part along the wall. Due to that, a conventional turbulent flow is commonly formed and stirring efficiency is enhanced by installing turbulent flow forming member 9 on the wall surface of stirring tank 2. Though in said stirring apparatus, the turbulent flow is locally formed, the presence of the formed turbulent flow tends to retard the flow of the medium. As a result, shearing against particles decreases to make it almost impossible to control the shape of particles.

Reaction apparatuses provided with stirring blades, which are preferably employed in a suspension polymerization method, will be described with reference to the drawings.

Figure 2:
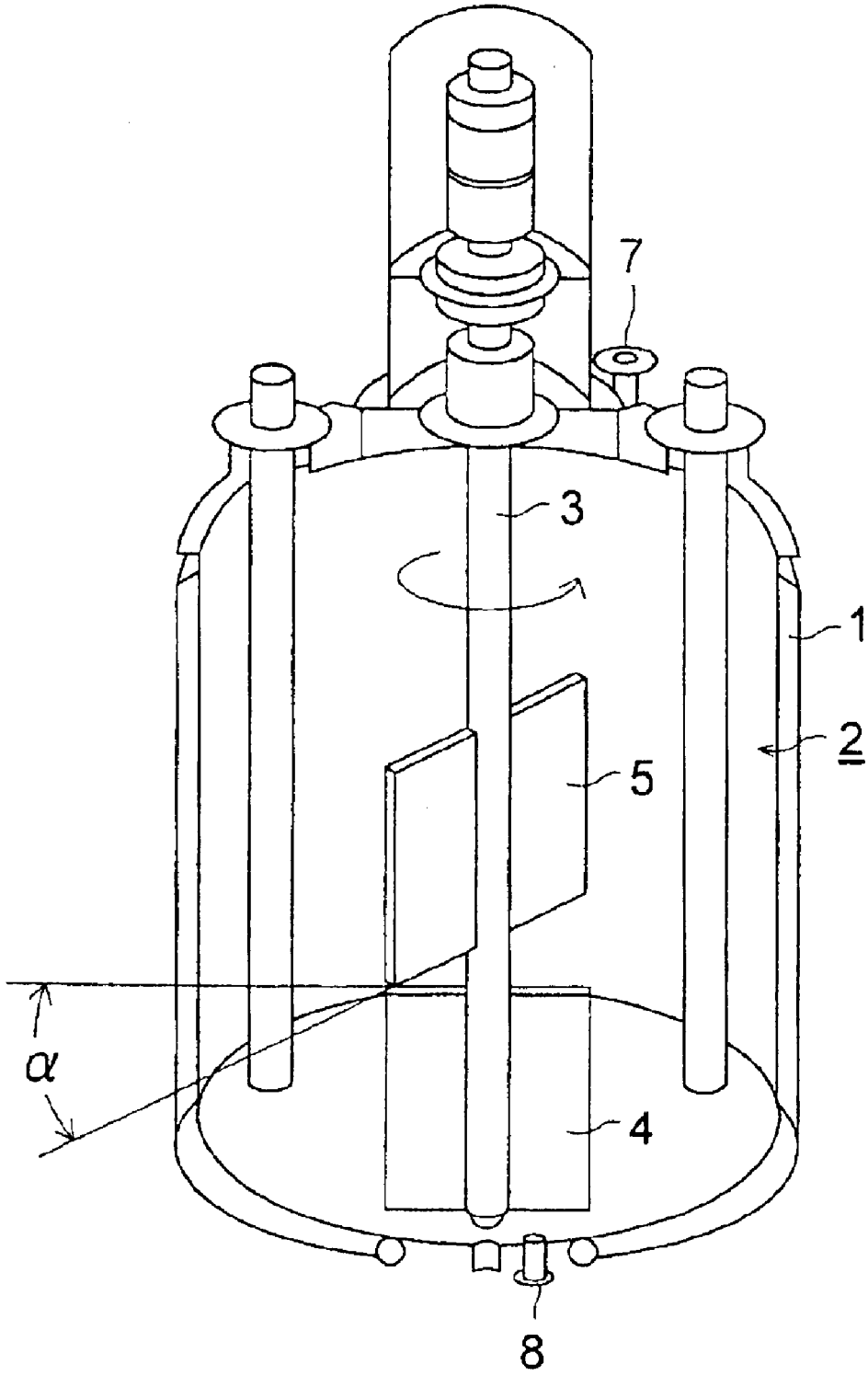
FIG. 2 is a perspective view showing one example of a reaction apparatus which is provided with preferably employable stirring blades.

FIG. 2 is a perspective view and a cross-sectional view, of the reaction apparatus described above, respectively. In the reaction apparatus, rotating shaft 3 is installed vertically at the center in vertical type cylindrical stirring tank 2 of which exterior circumference is equipped with a heat exchange jacket, and said rotating shaft 3 is provided with lower level stirring blades 4 installed near the bottom surface of said stirring tank 4 and upper level stirring blade 5. The upper level stirring blades 50 are arranged with respect to the lower level stirring blade so as to have a crossed axis angle $\alpha$ advanced in the rotation direction. When the toner of the presents invention is prepared, said crossed axis angle $\alpha$ is preferably less than 90 degrees. The lower limit of said crossed axis angle $\alpha$ is not particularly limited, but it is preferably at least about 5 degrees, and is more preferably at least 10 degrees. Incidentally, when stirring blades are constituted at three levels, the crossed axis angle between adjacent blades is preferably less than 90 degrees.

By employing the configuration as described above, it is assumed that, firstly, a medium is stirred employing stirring blades provided at the upper level, and a downward flow is formed. It is also assumed that subsequently, the downward flow formed by upper level stirring blades is accelerated by stirring blades installed at a lower level, and another flow is simultaneously formed by said stirring blades themselves, as a whole, accelerating the flow. As a result, it is further assumed that since a flow area is formed which has large shearing stress in the turbulent flow, it is possible to control the shape of the resultant toner.

Figure 3:
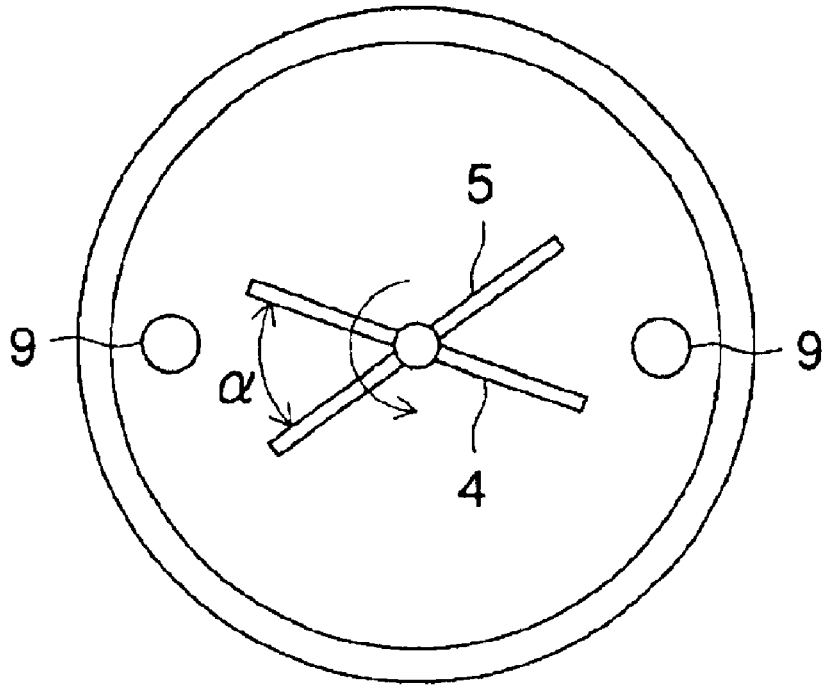
FIG. 3 is a cross-sectional view of the reaction apparatus shown in FIG. 2.

In FIGS. 2 and 3, arrows show the rotation direction, reference numeral 7 is upper material charging inlet, 8 is a lower material charging inlet, and 9 is a turbulent flow forming member which makes stirring more effective.

Figure 4:
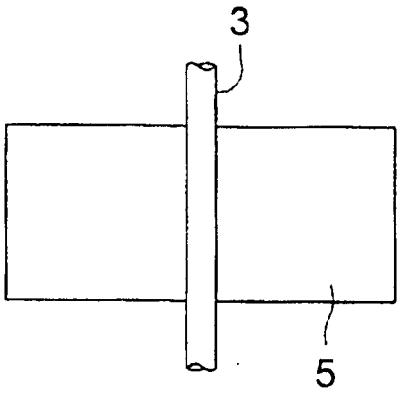
FIG. 4(*a*), 4(*b*) 4(*c*) and 4(*d*) are schematic view of examples of shape of stirring blade.
Figure 4:
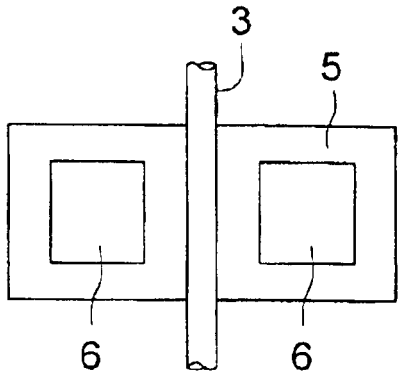
Figure 4:
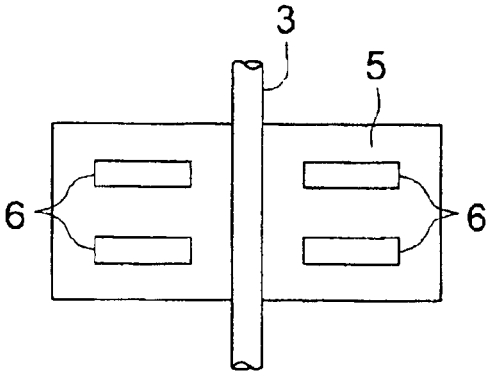
Figure 4:
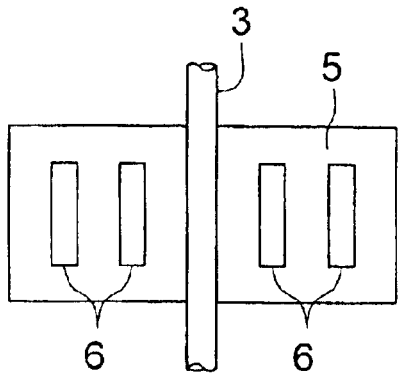
Figure 5:
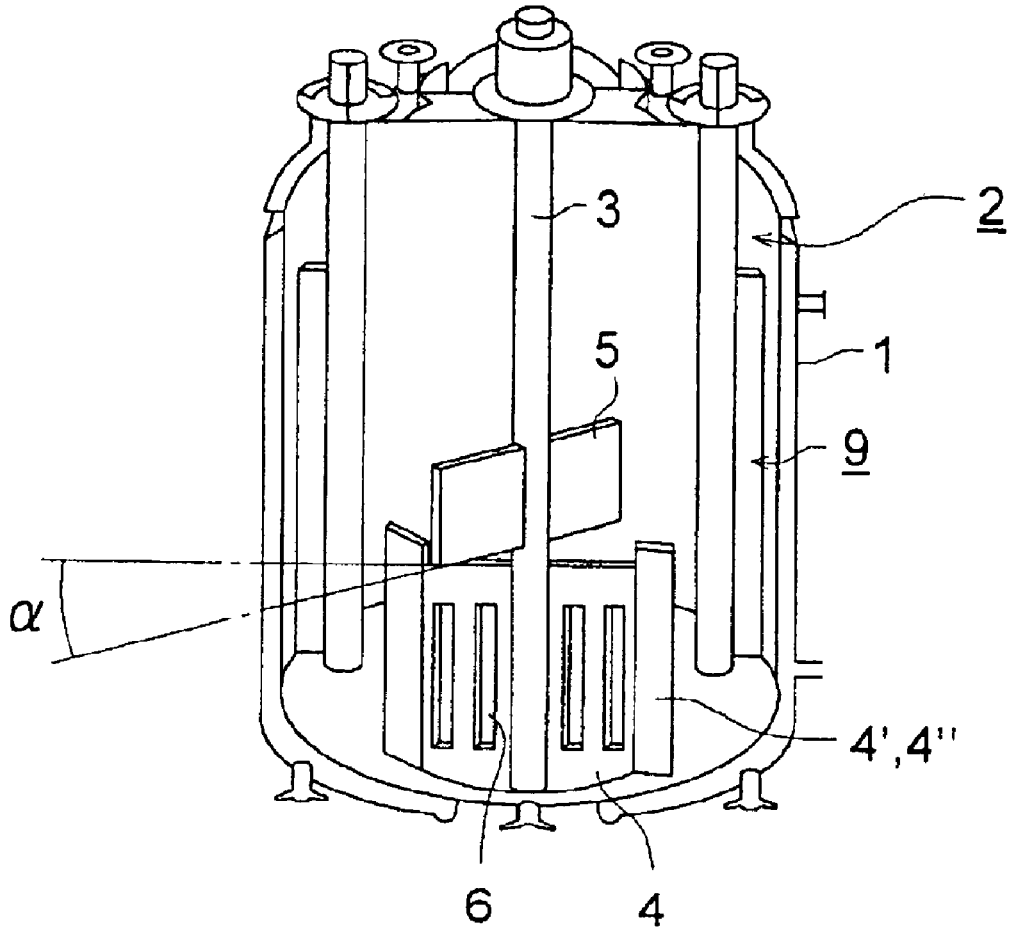
FIG. 5 is a perspective view showing a specific example of a reaction apparatus provided with the preferably employable stirring blades.
Figure 6:
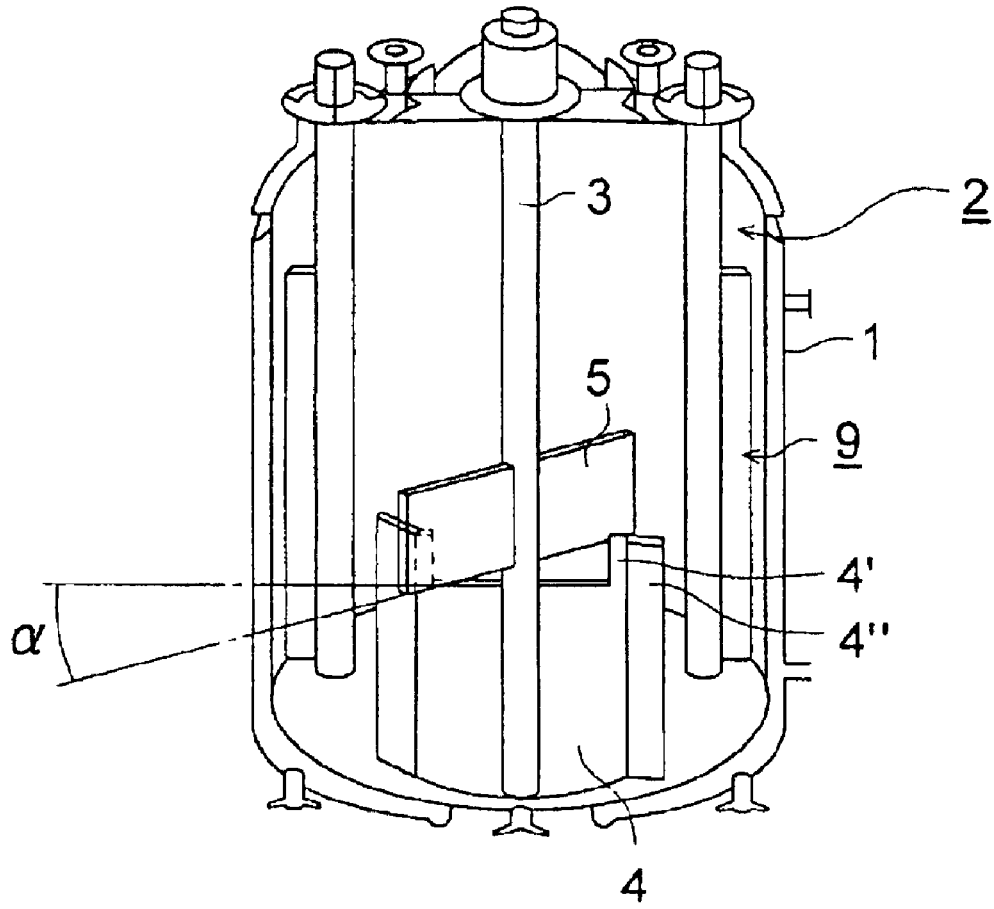
FIG. 6 is a perspective view showing a specific example of a reaction apparatus provided with the preferably employable stirring blades.
Figure 7:
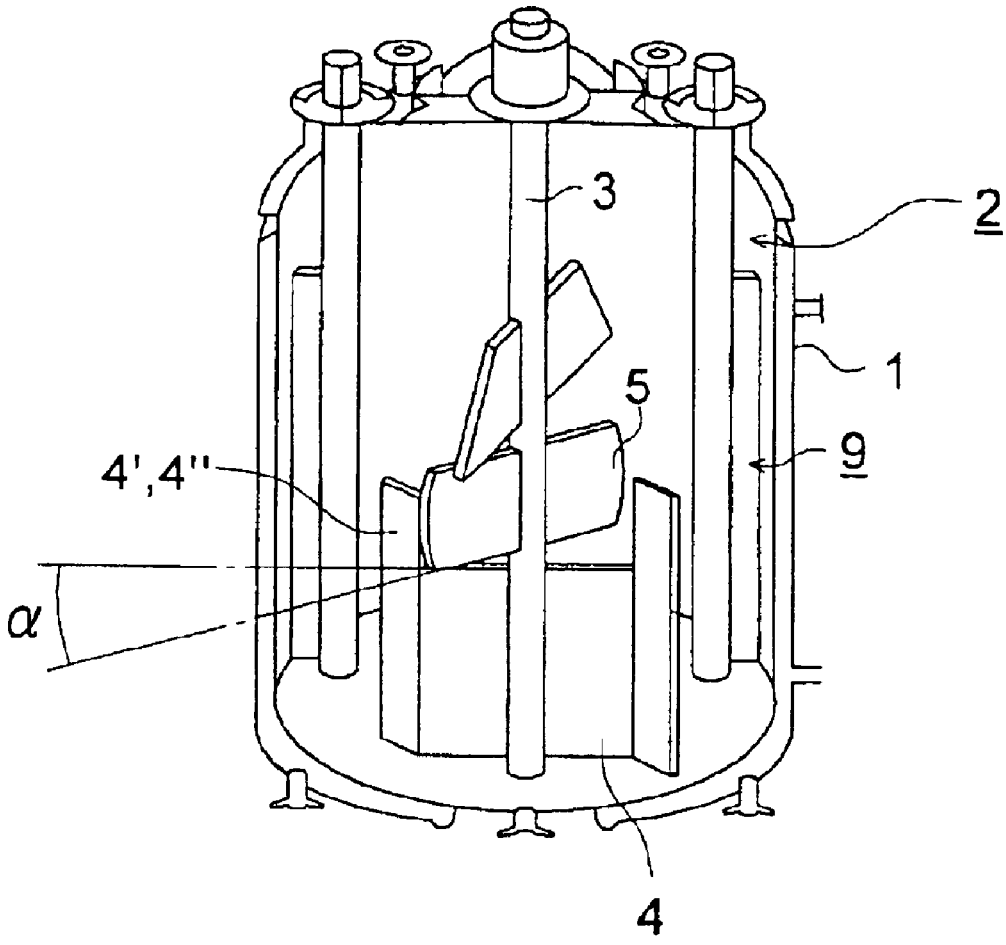
FIG. 7 is a perspective view showing a specific example of a reaction apparatus provided with the preferably employable stirring blades.
Figure 8:
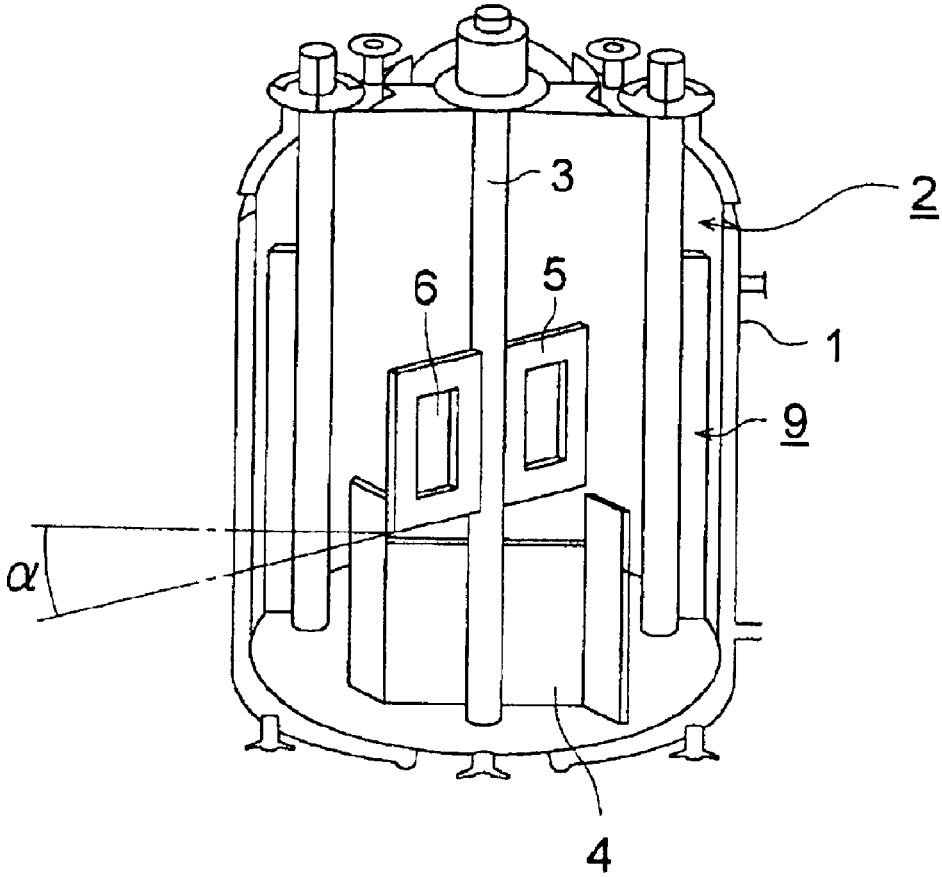
FIG. 8 is a perspective view showing a specific example of a reaction apparatus provided with the preferably employable stirring blades.

Herein, the shape of the stirring blades is not particularly limited, but employed may be those which are in square plate shape, blades in which a part of them is cut off, blades having at least one opening in the central area, having a so-called slit, and the like. FIGS. 4(*a*) to 4(*d*) describes specific examples of the shape of said blades. Stirring blade Sa shown in FIG. 4(*a*) has no central opening; stirring blade 5*b* shown in FIG. 4(*b*) has large central opening areas 6*b*; stirring blade 5*c* shown in FIG. 4(*c*) has rectangular openings 6*c* (slits); and stirring blade 5*d* shown in FIG. 4(*d*) has oblong openings 6*d* shown in FIG. 4(*d*). Further, when stirring blades of a three-level configuration are installed, openings which are formed at the upper level stirring blade and the openings which are installed in the lower level may be different or the same.

FIGS. 5 through 8 each show a perspective view of a specific example of a reaction apparatus equipped with stirring blades which may be preferably employed. In the reaction apparatus shown in FIG. 5, folded parts are formed on stirring blade and fins (projections) are formed on stirring blade. In stirring blade which constitutes the reaction apparatus shown in FIG. 6, slits, folded sections, and fins are formed simultaneously. The stirring blades at lower level has folded sections and fins at the end portion in the reaction apparatus shown in FIG. 7. The stirring blades at upper level has a slit and the stirring blades at lower level has folded sections and fins at the end portion in the reaction apparatus shown in FIG. 8. In the reaction apparatus shown in FIG. 7, stirring blades at three-level are provided. Further, when said folded sections are formed, the folded angle is preferably between 5 and 45 degrees.

Stirring blades having such folded sections, stirring blades which have upward and downward projections (fins), all generate an effective turbulent flow.

The space between the upper and the lower stirring blades is not particularly limited, but it is preferable that such a space is provided between stirring blades. The specific reason is not clearly understood. It is assumed that a flow of the medium is formed through said space, and the stirring efficiency is improved. However, the space is generally in the range of 0.5 to 50 percent with respect to the height of the liquid surface in a stationary state, and is preferably in the range of 1 to 30 percent.

Further, the size of the stirring blade is not particularly limited, but the sum height of all stirring blades is between 50 and 100 percent with respect to the liquid height in the stationary state, and is preferably between 60 and 95 percent.

Figure 9:
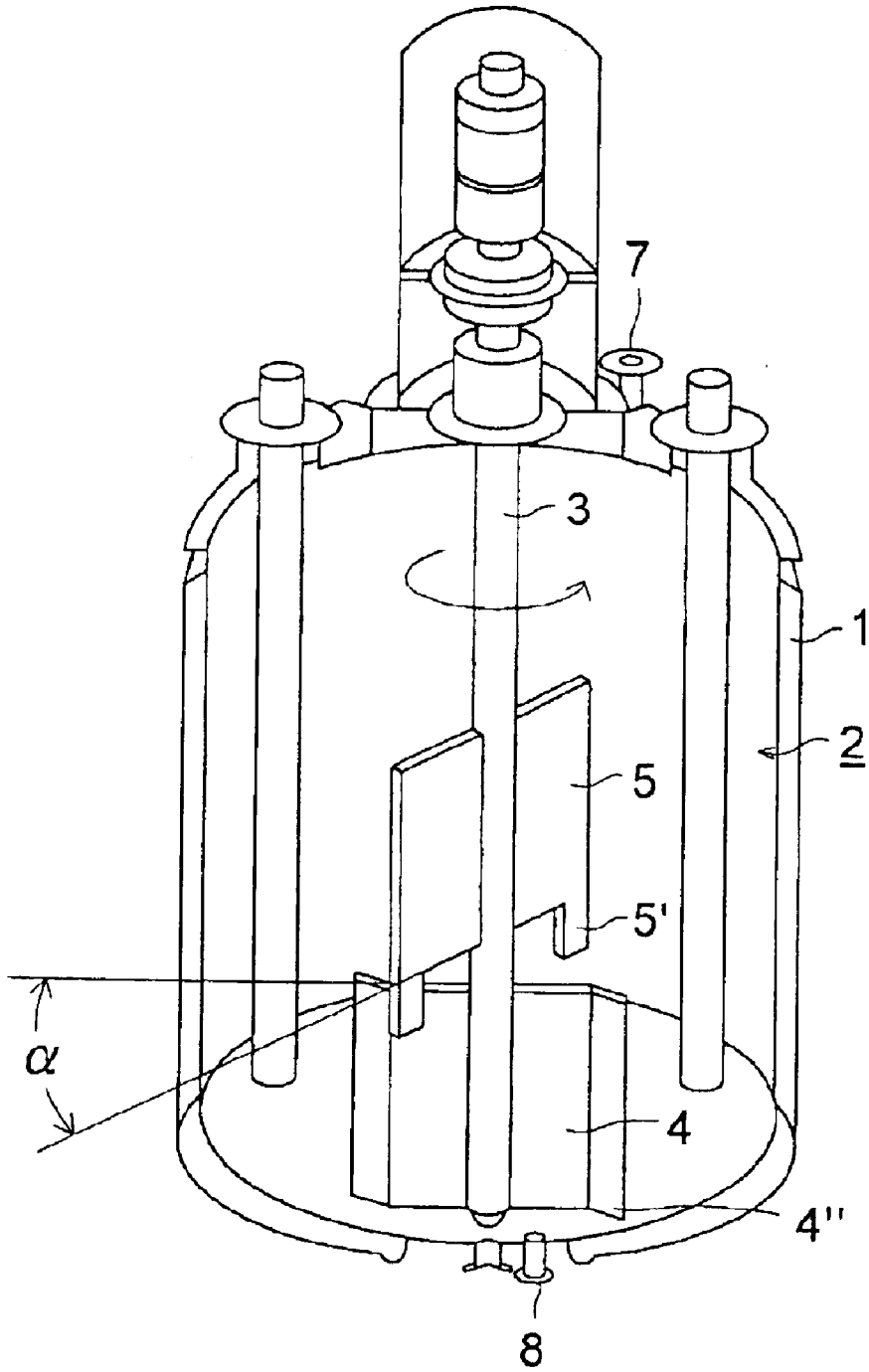
FIG. 9 is a perspective view showing a specific example of a reaction apparatus provided with the preferably employable stirring blades.

FIG. 9 shows one example of a reaction apparatus employed when a laminar flow is formed in the suspension polymerization method. Said reaction apparatus is characterized in that no turbulent flow forming member (obstacles such as a baffle plate and the like) is provided. The plurality of stirring blades are preferably provided so that upper level stirring blades 50 are arranged with respect to the lower level stirring blade so as to have a crossed axis angle α advanced in the rotation direction, as the blades for forming turbulent flow described above.

The shape of stirring blades, which constitute part of said reaction apparatuses, is not particularly limited as long as they do not form a turbulent flow, but rectangular plates and the like which are formed with a continuous plane as shown by FIG. 4(*a*) are preferable and may have a curved plane.

On the other hand, in toner which is prepared employing the polymerization method in which resinous particles are associated or fused in a water based medium, it is possible to optionally vary the shape distribution of all the toner particles as well as the shape of the toner particles by controlling the flow of the medium and the temperature distribution during the fusion process in the reaction vessel, and by further controlling the heating temperature, the frequency of rotation of stirring as well as the time during the shape controlling process after fusion.

In a toner which is prepared employing the polymerization method in which resinous particles are associated or fused, it is possible to form toner which has the specified shape coefficient and uniform distribution by controlling the temperature, the frequency of rotation, and the time during the fusion process, as well as the shape controlling process, employing the stirring blade and the stirring tank which are capable of forming a laminar flow in the reaction vessel as well as forming making the uniform interior temperature distribution. The reason is understood to be as follows: when fusion is carried out in a field in which a laminar flow is formed, no strong stress is applied to particles under coagulation and fusion (associated or coagulated particles) and in the laminar flow in which flow rate is accelerated, the temperature distribution in the stirring tank is uniform. As a result, the shape distribution of fused particles becomes uniform. Thereafter, further fused particles gradually become spherical upon heating and stirring during the shape controlling process. Thus it is possible to optionally control the shape of toner particles.

Employed as the stirring blades and the stirring tank, which are employed during the production of toner employing the polymerization method in which resinous particles are associated or fused, can be the same stirring blades and stirring tank which are employed in said suspension polymerization in which the laminar flow is formed, and for example, it is possible to employ the apparatus shown in FIG. 9. Said apparatus is characterized in that obstacles such as a baffle plate and the like, which forms a turbulent flow, is not provided. It is preferable that in the same manner as the stirring blades employed in the aforementioned suspension polymerization method, the stirring blades are constituted at multiple levels in which the upper stirring blade is arranged so as to have a crossed axis angle α in advance in the rotation direction with respect to the lower stirring blade.

Employed as said stirring blades may be the same blades which are used to form a laminar flow in the aforementioned suspension polymerization method. Stirring blades are not particularly limited as long as a turbulent flow is not formed, but those comprised of a rectangular plate as shown in FIG. 4(*a*), which are formed of a continuous plane are preferable, and those having a curved plane may also be employed.

Further, the toner of the present invention exhibits more desired effects when employed after having added fine particles such as fine inorganic particles, fine organic particles, and the like, as external additives. The reason is understood as follows: since it is possible to control burying and releasing of external additives, the effects are markedly pronounced.

Preferably employed as such fine inorganic particles are inorganic oxide particles such as silica, titania, alumina, and the like. Further, these fine inorganic particles are preferably subjected to hydrophobic treatment employing silane coupling agents, titanium coupling agents, and the like. The degree of said hydrophobic treatment is not particularly limited, but said degree is preferably between 40 and 95 in terms of the methanol wettability. The methanol wettability as described herein means wettability for methanol. The methanol wettability is measured as follows. 0.2 g of fine inorganic particles to be measured is weighed and added to 50 ml of distilled water, in a beaker having an inner capacity of 200 ml. Methanol is then gradually dripped, while stirring, from a burette whose outlet is immersed in the liquid, until the entire fine inorganic particles are wetted. When the volume of methanol, which is necessary for completely wetting said fine inorganic particles, is represented by "a" ml, the degree of hydrophobicity is calculated based on the formula described below:

$$\text{Degree of hydrophobicity}=[a/(a+50)]\times 100$$

The added amount of said external additives is generally between 0.1 and 5.0 percent by weight with respect to the toner, and is preferably between 0.5 and 4.0 percent. Further, external additives may be employed in combinations of various types.

A static latent image is representatively a photoreceptor, whose example includes an inorganic photoreceptor and an organic photoreceptor. The preferable example is the organic photoreceptor, particularly, composed of plural layers of a charge transporting layer and a charge generating layer.

In the image forming method, an image forming member or image forming unit is arranged for each of the four color developers, and a visible image is respectively formed on the photoreceptor drum for each of the colors and thus obtained visible images are successively transferred on to an externally supplied image support member and fixed at once to obtain a color image.

Figure 11:
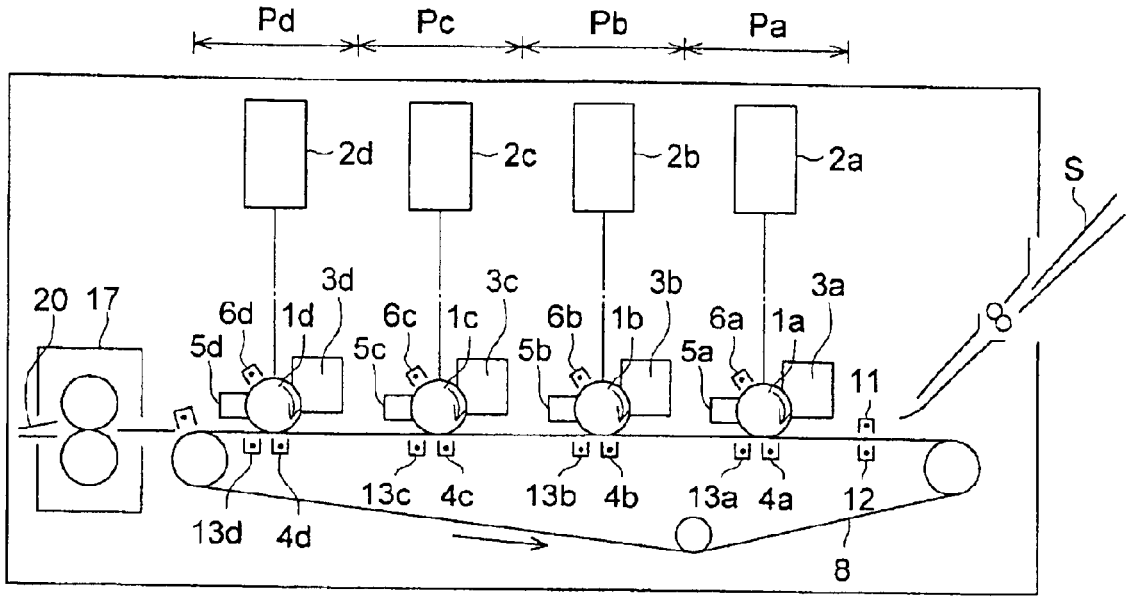
FIG. 11 is a schematic view showing image forming process

The image forming method in which plural color images are formed in the image forming zones and successively transferred onto the image support member is described according to FIG. 11.

In the image forming apparatus for forming a color image according to the invention, a plurality of image forming units is arranged by each of which visible toner images each having different color is respectively formed and successively transferred in pile onto the same image support member.

Such the image forming apparatus includes, for instance, one having the constitution shown in FIG. 11. In the apparatus, the first, second, third and fourth image forming units Pa, Pb, Pc and Pd are serially arranged and each of the image forming units has an exclusive image carrier or photoreceptor drum 1*a*, 1*b*, 1*c* and 1*d*, respectively.

Image forming devices 2*a*, 2*b*, 2*c* and 2*d*, developing devices 3*a*, 3*b*, 3*c* and 3*d*, transfer discharge devices 4*a*, 4*b*, 4*c* and 4*d*, and cleaning devices 5*a*, 5*b*, 5*c* and 5*d* are respectively arranged around the photoreceptors 1*a* through 1*d*.

In such the constitution, for instance, a latent image of a yellow component of a color original image is firstly formed by the image forming device 2*a* on the photoreceptor drum 1*a* of the first image forming unit Pa. The latent image is developed by a developer containing a yellow toner of the developing device 3*a* to be converted to a visible image and the visible image is transferred to the image support member S by the transfer discharging device 4*a*.

During the yellow image is transferred onto the image support member S as above-mentioned, a latent image of magenta component is formed on the photoreceptor drum 1*b* and converted to a visible image by a developer containing a magenta toner by the developing device 3*b* in the second image forming unit Pb. The visible magenta toner image is transferred to the prescribed position on the image support member S on which the image formed in the first image forming unit Pa is transferred, when the image support member is introduced to the position of the transfer discharging device 4*b*.

A cyan image and a black image are respectively formed by the third and fourth image forming unit Pc and Pd in the same procedure as in the above mentioned, and the cyan and black images are transferred in pile onto the same image support member. After finish of such the image forming processes, the image support member S is transported into the fixing device 17 and the images on the image support member are fixed. Thus a poly colored image is formed on the image support member S. Besides, the toner remained on each of the photoreceptor drums 1*a*, 1*b*, 1*c* and 1*d* is removed by the cleaning device 5*a*, 5*b*, 5*c* or 5*d* after the transfer and prepared to the image formation to be continued.

In the above-mentioned image forming apparatus, a conveyer belt 18 is used for conveying the image support member S. The image support member S is conveyed from the right side to the left side in FIG. 11, and passed in the course of the conveying through the transfer discharging devices 4*a*, 4*b*, 4*c* and 4*b* of the image forming units Pa, Pb, Pc and Pd to be subjected to image transfer.

In the image forming method, a conveyer belt using a mesh of polyester fiber or a conveyer belt using a thin dielectric sheet such as that of poly(ethylene terephthalate) resin, polyimide resin and urethane resin is utilized.

When the image support member S is passed through the fourth image forming unit Pd, AC voltage is applier to a charge eliminating device to eliminate the charge of the image support member S. Then the image support member is separated from the conveyer belt 18 and introduced into the fixing device 17 to fix the image, and output from an output opening 20.

In the drawing, 11 and 12 are each a charging device for absorption and 13*a*, 13*b*, 13*c* and 13*d* are each a discharging device for separation and charge elimination.

The developing device to be used in the invention is not limited of course to one shown in FIG. 11.

For example, as above-mentioned, a method in which a piled images are formed on a long intermediate transfer member such as the conveyer belt 18 and transferred at once onto an image support member and fixed, and a method in which the image forming units each has an independent intermediate transfer member and the image support member is conveyed by a belt type conveying means into the transfer zone of the intermediate transfer member, may be used.

A contact-heating fixing method can be described as a fixing method preferably usable in the invention. Particularly, a heat-pressing fixing method, moreover, a heating roller method and a pressure-contact-heating fixing method by using a rotatable pressure member including a heater fixed therein are usable.

The heater roller fixing method, the fixing device is constituted by an upper roller composed of a metal cylinder of iron or aluminum which is covered by tetrafluoroethylene or polytetrafluoroalkoxyvinyl ether layer and has a heating means interior of the cylinder, and a lower roller composed of silicone rubber. The heating means is usually a linear heater to heat the surface of the upper roller by about 120 to 200° C. Pressure is applied in the fixing zone between the upper and the lower rollers to deform the lower roller for forming a nip. The width of the nip is from 1 to 10 mm, preferably from 1.5 to 7 mm. The linear speed is preferably from 40 mm/sec to 600 mm/sec. When the nip is too narrow, unevenness of fixing is occurred since the heat cannot be uniformly applied to the toner. On the other hand, a problem of excessive fixing offset is raised when the nip is too wide since the melt of the resin is accelerated.

A mechanism for cleaning the fixing device may be attached. A method of supplying silicone oil to the upper fixing roller or a film and a method of cleaning by a pad, roller or web each immersed by silicone oil may be used as the cleaning mechanism.

The fixing method by rotatable pressure member including a heating means fixed therein usable in the invention is concretely described below.

This fixing method is a method in which the toner image is fixed by press-contact-heating by the fixed heating means and a pressing member facing and contacting with pressure to the heating member to contact the image support member to the heating member through a film.

In such the press-contact heating fixing device, the thermal capacity of the heating member is smaller than that of a usual heating roller and has a linear shaped heater arrange so as to be right angle with the passing direction of the image support member. The maximum temperature of the heating member is usually from 100 to 300° C.

The press-contact heating fixing is a method for fixing by contacting with pressure an unfixed toner image to a heating source such as a usually method by which the image support member carrying the unfixed toner is passed through between the heating member and the pressing member. A high fixing speed can be obtained by such the method since the heating can be carried out rapidly. However, the temperature control is difficultly performed and the adhesion and remaining of the toner so-called the offset of toner is tend to be occurred and a accident such as winding of the image support member around the fixing roller is also tend to be occurred.

Figure 12:
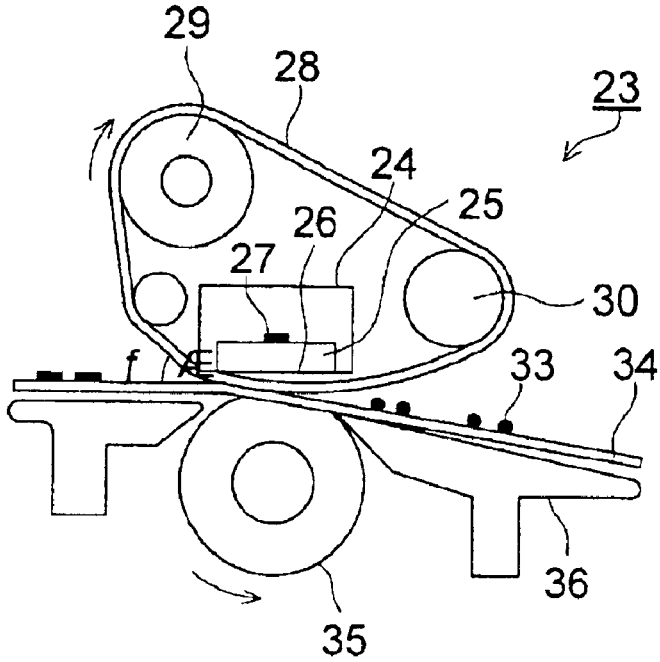
FIG. 12 is a schematic view showing a sectional view of an example of a fixing device according to the invention.
Figure 12:
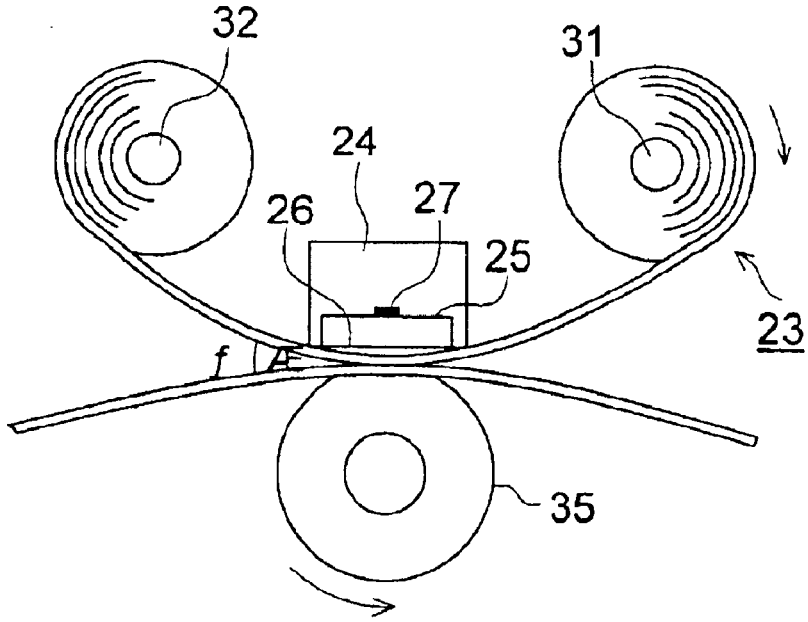

The cross section of the structure of the fixing device is shown in FIG. 12.

In FIG. 12*a*, 24 is a low thermal capacity linear shaped heater fixed to the device. An example of the heater is an aluminum substrate plate 25 having a height of 10 mm, a width of 10 mm and a longer side length of 240 mm coated with a resistive material in a thickness of 1.0 mm. The electric current is applied to the both ends of the longer side.

The electric current is usually applied in a form of pulse wave with a cycle of 2.0 millisecond of DC 100 V, and is controlled by signal from a temperature sensor 27 so as to hold the temperature at a prescribed value. The pulse width is varied according to the amount of irradiated energy. The range of the variation is, for instance, from 0.5 to 5 milliseconds.

The image support member S carrying unfixed toner image 33 is contacted to thus controlled heating member through a moving film 28 to fix by heat the toner image.

The film is moved without occurrence of wrinkle by the tension applied by the driving roller 29 and a roller 29 rotatable accompanied with the motion of the driving roller. 35 is a pressure roller having an elastic layer formed by silicone rubber, which presses the heating member through the film with the total pressure of from 40 to 200 N/cm. The unfixed toner image 33 carried on the image support member S is introduced into the fixing zone by an entrance guide 36 and heated to forming the fixed image.

The above-mentioned description is according to the case of using the endless belt, but a fixing film having both ends may be applied, in such the case a film sheet outlet axis 31 and a winding axis 32 are used as shown in FIG. 12*b*.

EXAMPLES

The present inventing will now be detailed with reference to examples. The term "part(s)" denotes part(s) by weight.

Toner Preparation Example 1

Added to 10.0 liters of pure water was 0.90 kg of sodium n-dodecylsulfate, and was subsequently dissolved. Gradually added to the resulting solution were 1.20 kg of Regal 330R (carbon black manufactured by Cabot Corp.). The resulting mixture was suitably stirred for one hour, and thereafter, was continuously dispersed for 20 hours employing a sand grinder (a medium type homogenizer). The resulting dispersion was designated as "Colorant Dispersion 1". A solution comprised of 0.055 kg of sodium dodecylbenzenesulfonate and 4.0 liters of deionized eater was designated as "Anionic Surface Active Agent Solution A".

A solution comprised of 0.014 g of a nonylphenolpolyethylene oxide 10 mole addition product and 4.0 liters of deionized water was designated as "Nonionic Surface Active Agent Solution B". A solution prepared by dissolving 223.8 g of potassium persulfate in 12.0 liters of deionized water was designated as "Initiator Solution C".

Charged into a 100 liter GL (glass lined) reaction vessel fitted with a thermal sensor were 3.41 kg of WAX emulsion (polypropylene emulsion having a number average molecular weight of 3,000, a number average primary particle diameter of 120 nm, and a solid concentration of 29.9 percent), the total amount of "Anionic Surface Active Agent A", and the total amount of "Nonionic Surface Active Agent Solution B", and the resulting mixture was stirred. Subsequently, 44.0 liters of deionized water were added.

When the resulting mixture reached 75° C., the total amount of "Initiator Solution C" was added. Thereafter, while maintaining the resulting mixture at 75±1° C., a mixture consisting of 12.1 kg of styrene, 2.88 kg of n-butyl acrylate, 1.04 kg of methacrylic acid, and 548 g of t-dodecylmercaptan was added dropwise. After said dropwise addition, the resulting mixture was heated to 80±1° C. and stirred for 6 hours while maintaining said temperature. Subsequently, the temperature was lowered to no more than 40° C. and stirring was stopped. The resulting products were filtered employing a pole filter and the resulting filtrate was designated as "Latex (1)-A".

The resinous particles in said Latex (1)-A exhibited a glass transition temperature of 57° C. and a softening point of 121° C., a weight average molecular weight of 12,700 regarding the molecular weight distribution, and a weight average particle diameter of 120 nm.

Further, a solution prepared by dissolving 0.055 kg of sodium dodecylbenzenesulfonate in 4.0 liters of deionized water was designated as "Anionic Surface Active Agent Solution D". Further, a solution prepared by dissolving 0.014 kg of a nonylphenolpolyethylene oxide 10 mole addition product in 4.0 liters of deionized water was designated as "Nonionic Surface Active Agent Solution E".

A solution prepared by dissolving 200.7 g of potassium persulfate (manufactured by Kanto Kagaku Co.) in 12.0 liters of deionized water was designated as "Initiator Solution F".

Charged into a 100 liter GL reaction vessel fitted with a thermal sensor, a cooling pipe, a nitrogen gas inlet, a comb shaped baffle, and a stirring blade shown by FIG. 4(*a*), were 3.41 kg of WAX emulsion (polypropylene emulsion having a number average molecular weight of 3,000, a number average primary particle diameter of 120 nm, and a solid concentration of 29.9 percent), the total amount of "Anionic Surface Active Agent D", and the total amount of "Nonionic Surface Active Agent Solution E", and the resulting mixture was stirred. Subsequently, 44.0 liters of deionized water were added. When the heated resulting mixture reached 70° C., "Initiator Solution F" was added. Subsequently, a solution previously prepared by mixing 11.0 kg of styrene, 4.00 kg of n-butyl acrylate, 1.04 kg of methacrylic acid, and 9.02 g of t-dodecylmercaptan was added dropwise. After said dropwise addition, the resulting mixture was maintained at 72±2° C. and stirred for 6 hours while maintaining said temperature. Subsequently, the temperature was raised to 80±2° C., and stirring was carried out for 12 more hours while controlling the temperature within said range. The temperature was then lowered to no more than 40° C., and stirring was stopped. The resulting products were filtered employing a pole filter and the resulting filtrate was designated as "Latex (1)-B".

The resinous particles in said Latex (1)-B exhibited a glass transition temperature of 58° C. and a softening point of 132° C., a weight average molecular weight of 245,000 regarding the molecular weight distribution, and a weight average particle diameter of 110 nm.

A solution prepared by dissolving 5.36 kg of sodium chloride as the salting-out agent in 20.0 liters of deionized water was designated as "Sodium Chloride Solution G".

A solution prepared by dissolving 1.00 g of a fluorine based nonionic surface active agent in 1.00 liter of deionized water was designated as "Nonionic Surface Active Agent Solution H".

Charged into a 100 liter SUS reaction vessel, the reaction apparatus having a crossed axes angle a of 20 degrees, the stirring blade shown by FIG. 4(*a*), fitted with a thermal sensor, a cooling pipe, a nitrogen gas inlet, a particle diameter and shape monitoring device, were 20.0 kg of Latex (1)-A and 5.2 kg of Latex (1)-B as prepared above, 0.4 kg of Colorant Dispersion, and 20.0 kg of deionized water, and the resulting mixture was stirred. Subsequently, the mixture was heated to 40° C., and said Sodium Chloride Solution G and 6.00 kg of isopropanol (manufactured by Kanto Kagaku Co.), and said Nonionic Surface Active Agent Solution G were added in said order. Thereafter, the resulting mixture was put aside for 10 minutes, and then heated to 85° C. over a period of 60 minutes. While being heated at 85±2° C. for the period of from 0.5 to 3 hours while stirring, the mixture was subjected to salting-out/fusion so that the particle diameter increased. Subsequently, the increase in the particle diameter was terminated by the addition of 2.1 liters of pure water.

Charged into a 5 liter reaction vessel (the stirring blade being shown by FIG. 9), fitted with a thermal sensor, a cooling pipe, and a particle diameter and shape monitoring device, were 5.0 kg of the coalesced particle dispersion as prepared above, and said dispersion was heated at 85±2° C. for a period of from 0.5 to 15 hours so as to control the particle shape. Thereafter, the resulting dispersion was cooled to no more than 40° C. and stirring was terminated. Subsequently, while employing a centrifuge, classification was carried out in the liquid medium utilizing a centrifugal sedimentation method, and filtration was carried out employing a 45 μm sieve. The resulting filtrate was designated as Coalesced Liquid Medium (1). Subsequently, wet cake-like non-spherical particles were collected from said Coalesced Liquid Medium (1) through filtration employing a Buchner's funnel, and then washed with deionized water.

The resulting non-spherical particles were dried at an air intake temperature of 60° C., employing a flash jet dryer, and subsequently dried at 60° C. employing a fluidized layer dryer. Externally added to 100 parts by weight of the obtained colored particles were 1 part by weight of fine silica particles and 0.1 part by weight of zinc stearate, and the resulting mixture was blended employing a Henschel mixer, whereby toners shown in the table below were obtained which were prepared employing the emulsion polymerization coalescence method.

Toners T1 through T5 shown in Table 1 were obtained by controlling the shape as well as the variation coefficient of the shape coefficient through controlling the rotation frequency of the stirrer as well as the heating time during said salting-out/fusion stage and the monitoring of the shape controlling process, and further regulating the particle diameter and the variation coefficient of the size distribution.

Toner Preparation Example 2

Toners T6 through T10 shown in Table 1 were obtained by the same way except that the colorant carbon black was replaced with 1.05 kg of a benzidine yellow pigment.

Toner Preparation Example 3

Toners T11 through T15 shown in Table 1 were obtained by the same way except that the colorant carbon black was replaced with 1.20 kg of a quinacridone magenta pigment.

Toner Preparation Example 3

Toners T11 through T15 shown in Table 1 were obtained by the same way except that the colorant carbon black was replaced with 1.20 kg of a phthalocyanine cyan pigment.

TABLE 1

| Toner No. | Color | Shape Coefficient Ratio of 1.0 to 1.6 (in %) | Shape Coefficient Ratio of 1.2 to 1.6 (in %) | Variation Coefficient of Shape Coefficient (in %) | Ratio of Toner Particles Without Corners (in %) | Number Average Particle Diameter (in μm) | Variation Coefficient of Particle Number Distribution (in %) | Sum M of $m_1$ and $m_2$ (in %) |
|---|---|---|---|---|---|---|---|---|
| Toner 1 | Bk | 91.2 | 73.2 | 12.1 | 94 | 5.7 | 20.7 | 82.3 |
| Toner 2 | Bk | 64.2 | 62.0 | 15.6 | 42 | 8.7 | 26.8 | 67.0 |
| Toner 3 | Bk | 63.9 | 62.0 | 17.4 | 53 | 8.8 | 25.9 | 68.5 |
| Toner 4 | Bk | 89.5 | 66.7 | 15.1 | 40 | 8.7 | 28.7 | 64.8 |
| Toner 5 | Bk | 63.8 | 61.5 | 18.0 | 44 | 8.8 | 28.4 | 65.3 |
| Toner 6 | Y | 88.4 | 74.4 | 12.4 | 93 | 5.8 | 21.3 | 83.1 |
| Toner 7 | Y | 63.9 | 62.2 | 15.5 | 41 | 8.6 | 26.7 | 67.9 |
| Toner 8 | Y | 62.8 | 60.7 | 17.7 | 56 | 9.0 | 26.0 | 68.2 |
| Toner 9 | Y | 92.1 | 68.0 | 14.9 | 44 | 8.6 | 28.6 | 65.3 |
| Toner 10 | Y | 63.2 | 61.1 | 17.8 | 41 | 8.8 | 27.9 | 65.1 |
| Toner 11 | M | 90.3 | 74.1 | 13.1 | 95 | 5.6 | 20.8 | 83.4 |
| Toner 12 | M | 62.8 | 60.6 | 15.2 | 42 | 8.7 | 26.2 | 68.1 |
| Toner 13 | M | 63.4 | 61.2 | 17.1 | 57 | 8.7 | 26.4 | 67.8 |
| Toner 14 | M | 90.4 | 67.8 | 14.8 | 41 | 8.8 | 28.8 | 64.6 |
| Toner 15 | M | 62.8 | 60.7 | 17.9 | 42 | 9.0 | 28.6 | 64.4 |
| Toner 16 | C | 89.4 | 75.2 | 12.6 | 96 | 5.7 | 21.2 | 82.9 |
| Toner 17 | C | 63.8 | 61.8 | 15.7 | 40 | 8.7 | 26.0 | 68.5 |
| Toner 18 | C | 63.7 | 60.9 | 18.0 | 55 | 8.7 | 26.5 | 67.6 |
| Toner 19 | C | 89.7 | 66.5 | 15.0 | 40 | 8.7 | 27.9 | 65.2 |
| Toner 20 | C | 63.6 | 61.3 | 18.1 | 40 | 8.9 | 28.5 | 64.9 |

Said toners 1 through 20 were blended with a styrene-methacrylate copolymer resin coated ferrite carrier having a volume average particle diameter of 45 μm, and Developer 1 in amount as shown in Table 2 was prepared.

TABLE 2

| Color | Toner (g) | Carrier (g) |
|---|---|---|
| Bk | 19.8 | 200.2 |
| Y | 20.7 | 209.3 |
| M | 20.7 | 209.3 |
| C | 20.7 | 209.3 |

Color images were formed by employing the image forming apparatus shown in FIG. 11, with color toner combination as shown in Table 3.

A photosensitive drum having multi-layer organic photoreceptor was employed. Residual toner on the photoreceptor was cleaned by a blade cleaning device.

A pressured type thermal fixing device was employed. The fixing device comprises an upper roller composed of 30 mm diameter iron tube covered with polytetrafluoroalkylvinyl ether copolymer layer on the surface and having heater incorporated in the center, and a lower roller composed of 30 mm diameter silicone rubber covered with polytetrafluoroalkylvinyl ether copolymer layer on the surface. The line pressure was set at 8.0 N/cm, and nip width was 4.3 mm. Line speed of printing was set at 250 mm/sec. The fixing temperature was controlled by the surface temperature of the upper roller at 185° C. Polydiphenyl silicone having viscosity of 10 Pa s at 20° C. was impregnated in the web and supplied through the web to the cleaning device of the fixing device.

The image was printed on a paper, having basis weight of 55 kg, in the longitudinal direction.

Full color image having pixel ratio of 45% was formed on 20,000 sheets at 22° C. and 60% RH, by such an intermittent way that a pause was made after each sheet of copying. Image quality of the initial copy and 20,000th copy was evaluated.

Blur characters (definition of image reproduced lines per mm) and drift of colors in printing were evaluated. Drift of colors was ranked by the following criteria through eyes view.

A: No color drift was observed.

B: Slight drift of color and slight impure color due to color mixture were observed.

C: Drift of colors and fair impure color due to color mixture were observed.

D: Drift of colors was observed and intermediate colors were not reproduced with color impurity due to color mixture.

TABLE 3

| | Toner | | Definition (lines/mm) | | Color Drift | |
|---|---|---|---|---|---|---|
| Example No. | No. | Color | Initial | 20,000th | Initial | 20,000th |
| Example 1 | 6 | Y | 8 | 8 | A | A |
| | 11 | M | 8 | 7 | A | A/B |
| | 16 | C | 8 | 8 | A | A/B |
| | 1 | Bk | 8 | 7 | A | A |
| Example 2 | 7 | Y | 7 | 7 | A | A/B |
| | 12 | M | 7 | 7 | A | A/B |
| | 17 | C | 7 | 7 | A/B | B |
| | 2 | Bk | 7 | 7 | A | A |
| Example 3 | 8 | Y | 7 | 6 | A | B |
| | 13 | M | 7 | 7 | A | A/B |
| | 18 | C | 7 | 6 | A/B | B |
| | 3 | Bk | 7 | 7 | A | A/B |
| Example 4 | 9 | Y | 7 | 7 | A/B | B |
| | 14 | M | 7 | 6 | A | A/B |
| | 19 | C | 7 | 7 | A | A/B |
| | 4 | Bk | 7 | 7 | A | A |
| Comparative Example | 10 | Y | 5 | 4 | C | D |
| | 15 | M | 5 | 4 | C | D |
| | 20 | C | 5 | 4 | C | D |
| | 5 | Bk | 5 | 4 | C | C/D |

The result shows that a high quality image without occurrence of the blur character due to toner scattering and image discrepancy by the tandem color image forming system are obtained by the invention.

What is claimed is:

1. An image forming method comprising forming latent images on static latent image forming members, at least one image being formed on each member, developing each latent image by toners to form toner images, at least one of the toners having a variation coefficient of the shape coefficient of not more than 16% and a number variation coefficient of the particle size distribution of not more than 27%, successively transferring each of the toner images onto an image support so as to form a piled up image, and fixing the piled up image on the image support.

2. The image forming method of claim 1, wherein a plurality of image forming units each including the static latent image forming member are arranged serially, and fixing is carried out by a fixing device having a rotatable heating member including a heater fixed therein and a pressing member.

3. The image forming method of claim 1, wherein all the toners have the variation coefficient of the shape coefficient of not more than 16% and the number variation coefficient of the particle size distribution of not more than 27%.

4. The image forming method of claim 2, wherein at least one of the toners contains toner particles each having a shape coefficient within the range of 1.0 to 1.6 in a ratio of not less than 65% in number.

5. The image forming method of claim 2, wherein at least one of the toners contains toner particles each having a shape coefficient within the range of 1.2 to 1.6 in a ratio of not less than 65% in number.

6. The image forming method of claim 2, wherein at least one of the toners contains toner particles having no corner in a ratio of not less than 50% in number.

7. The image forming method of claim 2, wherein at least one of the toners has a number average diameter of from 3 to 8 $\mu$m.

8. The image forming method of claim 2, wherein the sum M of the relative frequency of the toner particles contained at least one of the toners included in the highest frequency class m1 and a relative frequency of the toner particles included in the next high frequency class m2 is not less than 70% in a histogram showing a particle diameter distribution in number classified into plural classes every 0.23 of natural logarithm ln D graduated on the horizontal axis of the histogram, where D is the diameter of the toner particle in $\mu$m.

9. The image forming method of claim 2, wherein at least one of the toner is one prepared by polymerizing a polymerizable monomer in an aqueous medium.

10. The image forming method of claim 2, wherein at least one of the toner is one prepared by association of resin particles in an aqueous medium.

11. An image forming method comprising the steps of forming latent images on static latent image forming members, at least one image being formed on each member, developing each latent image by toners to form toner images, at least one of the toner contains toner particles having no corner in a ratio of not less than 50% and a number variation coefficient of the particles diameter distribution in number of not more than 27%, successively transferring each of the toner images onto an image support so as to form a piled up image, and fixing the piled up image on the image support.

12. The image forming method of claim 11, wherein a plurality of image forming units each including the static latent image forming member are arranged serially, and fixing is carried out by a fixing device having a rotatable heating member including a heater fixed therein and a pressing member.

13. The image forming method of claim 11, wherein all the toners contain toner particles having no corner in a ratio of not less than 50% and the number variation coefficient of the particles diameter distribution in number of not more than 27%.

14. The image forming method of claim 12, wherein at least one of the toners contains toner particles each having a shape coefficient within the range of 1.0 to 1.6 in a ratio of not less than 65% in number.

15. The image forming method of claim 12, wherein at least one of the toners contains toner particles each having a shape coefficient within the range of 1.2 to 1.6 in a ratio of not less than 65% in number.

16. The image forming method of claim 12, wherein at least one of the toners has a number average diameter of from 3 to 8 $\mu$m.

17. The image forming method of claim 12, wherein the sum M of the relative frequency of the toner particles contained in at least one of the toners included in the highest frequency class m1 and a relative frequency of the toner particles included in the next high frequency class m2 is not less than 70% in a histogram showing a particle diameter distribution in number classified into plural classes every 0.23 of natural logarithm ln D graduated on the horizontal axis of the histogram, where D is the diameter of the toner particle in $\mu$m.

18. The image forming method of claim 12, wherein at least one of the toners is one prepared by polymerizing a polymerizable monomer in an aqueous medium.

19. The image forming method of claim 12, wherein at least one of toners is one prepared by association of resin particles in an aqueous medium.

20. An image forming method comprising the steps of forming latent images on static latent image forming members, at least one image being formed on each member, developing each latent image by toners form toner images, at least one of the toner contains toner particles each having a shape coefficient within the range of from 1.2 to 1.6 in a ratio of not less than 65% in number and a variation coefficient of the shape coefficient of not more than 16%, successively transferring each of the toner images onto an image support so as to form a piled up image, and fixing the piled up image on the image support.

21. The image forming method of claim 20, wherein a plurality of image forming units each including the static latent image forming member are arranged serially, and fixing is carried out by a fixing device having a rotatable heating member including a heater fixed therein and a pressing member.

22. The image forming method of claim 20, wherein all the toners contain toner particles each having the shape coefficient within the range of from 1.2 to 1.6 in a ratio of not less than 65% in number and the variation coefficient of the shape coefficient of not more than 16%.

23. The image forming method of claim 21, wherein at least one of the toners contains toner particles each having a shape coefficient within the range of 1.0 to 1.6 in a ratio of not less than 65% in number.

24. The image forming method of claim 21, wherein at least one of the toners has a number average diameter of from 3 to 8 $\mu$m.

25. The image forming method of claim 21, wherein the sum M of the relative frequency of the toner particles contained in at least one of the toners included in the highest frequency class m1 and a relative frequency of the toner particles included in the next high frequency class m2 is not less than 70% in a histogram showing a particle diameter distribution in number classified into plural classes every 0.23 of natural logarithm ln D graduated on the horizontal axis of the histogram, where D is the diameter of the toner particle in $\mu$m.

26. The image forming method of claim 21, wherein at least one of the toners is one prepared by polymerizing a polymerizable monomer in an aqueous medium.

27. The image forming method of claim 21, wherein at least one of the toners is one prepared by association of resin particles in an aqueous medium.

28. An image forming apparatus for developing latent images each formed on a static latent image forming member by serially arranged plural image forming units each including a toner to form toner images, respectively, successively transferring the toner images onto an image support so as to form a piled up image, and fixing the piled up image by a fixing device having a rotatable heating member including a heater fixed therein and a pressing member, wherein each of the toner has a variation coefficient of the shape coefficient of not more than 16% and a number variation coefficient of the particle size distribution of not more than 27%.

29. An image forming apparatus for developing latent images each formed on a static latent image forming member by serially arranged plural image forming units each including a toner to form toner images, respectively, successively transferring the toner images onto an image support so as to form a piled up image, and fixing the piled up image by a fixing device having a rotatable heating member including a heater fixed therein and a pressing member, wherein each of the toner contains toner particles having no corner in a ratio of not less than 50% and a number variation coefficient of the particles diameter distribution in number of not more than 27%.

30. An image forming apparatus for developing latent images each formed on a static latent image forming member by serially arranged plural image forming units each including a toner to form toner images, respectively, successively transferring the toner images onto an image support so as to form a piled up image, and fixing the piled up image by a fixing device having a rotatable heating member including a heater fixed therein and a pressing member, wherein each of the toner for contains toner particles each having a shape coefficient within the range of from 1.2 to 1.6 in a ratio of not less than 65% in number and a variation coefficient of the shape coefficient of not more than 16%.

* * * * *